US006575879B1

(12) United States Patent
Harney et al.

(10) Patent No.: US 6,575,879 B1
(45) Date of Patent: Jun. 10, 2003

(54) METHOD AND APPARATUS FOR ASSESSING A USER ATHLETE

(75) Inventors: Randy Harney, 2344 Hampden Ave., Apt. #304, St. Paul, MN (US) 55114; Ryan Fuchs, 7800 Powell Rd., Hopkins, MN (US) 55343

(73) Assignees: Ryan Fuchs, Hopkins, MN (US); Randy Harney, St. Paul, MN (US)

( * ) Notice: Subject to any disclaimer, the term of this patent is extended or adjusted under 35 U.S.C. 154(b) by 317 days.

(21) Appl. No.: 09/794,775

(22) Filed: Feb. 27, 2001

Related U.S. Application Data

(60) Provisional application No. 60/193,316, filed on Mar. 30, 2000.

(51) Int. Cl.[7] ..... A63B 22/00

(52) U.S. Cl. ..... 482/54; 482/51; 434/251; 473/441

(58) Field of Search ..... 482/51, 54, 1–9, 482/900, 901, 902, 14, 83, 84, 86; 434/251, 247; 473/415, 422, 438, 441–445

(56) References Cited

U.S. PATENT DOCUMENTS

| | | | | |
|---|---|---|---|---|
| 4,534,557 | A | 8/1985 | Bigelow | |
| 4,890,495 | A | 1/1990 | Slane | |
| 5,152,733 | A | 10/1992 | Farenholtz | |
| 5,474,290 | A | 12/1995 | Rascona | |
| 6,093,119 | A | 7/2000 | Tipton | |
| 6,287,240 | B1 * | 9/2001 | Trabbic | 482/54 |
| 6,387,015 | B1 * | 5/2002 | Watson | 482/54 |

OTHER PUBLICATIONS

Lakomy, *An Ergomether for Measuring the Power Generated During Sprinting, Physiological Society*, Apr. 1984, pp 33P.

Lakomy, *The Use of a Non–motorized Treadmill for Analysing Spring Performance, Ergonomics*, 1987, vol. 30, No. 4, pp 627–637.

Edited by John A. Hawley, *Physiology and Biochemistry of Sprinting, Running*, Chapter 1, pp 1–13.

A. Jaskólska, *Comparison of Treadmill and Cycle Ergometer Measurements of Force–Velocity Relationships and Power Output, Int J Sports Med*, 1999, pp 192–197.

K. Funato et al., *Ergometry for Estimation of Mechanical Power Output in Sprinting in Humans Using a Newly Developed Self–driven Treadmill, Eur J Appl Physiol*, 2001, pp 169–173.

R. Kram et al., *Force Treadmill for Measuring Vertical and Horizontal Ground Reaction Forces, American Physiological Society*, 1998, pp 764–769.

A. Jaskólska, *Optimal Resistance for Maximal Power During Treadmill Running*, Sports Med, Training and Rehab*, 1996, vol. 7, pp 17–30.

S.M. Chelly, *Leg Power and Hopping Stiffness: Relationship With Spring Running Performance, Medicine & Science in Sports & Exercise*, 2001, pp 326–333.

* cited by examiner

*Primary Examiner*—Glenn E. Richman
(74) *Attorney, Agent, or Firm*—Patterson, Thuente, Skaar & Christensen, P.A.

(57) ABSTRACT

A method and apparatus for assessing a user athlete's prowess at certain athletic skills, the apparatus being treadmill sled having a frame, a rotatable continuous belt mounted on the frame, the belt presenting an upward directed support surface for supporting a user athlete, a blocking dummy supported proximate the continuous belt and being operably coupled to the frame by a dummy support, and a performance measuring system.

16 Claims, 20 Drawing Sheets

10
12
14
18
30
48, 50
34
38
36
58
52
54
56
170
20
62
168
51
16
22
163
172
96
40

METHOD AND APPARATUS FOR ASSESSING A USER ATHLETE

RELATED APPLICATIONS

The present invention claims the benefit of U.S. Provisional Application No. 60/193,316, filed Mar. 30, 2000, hereby incorporated in its entirety by reference.

TECHNICAL FIELD

The present invention relates to a method and apparatus for assessing a user athlete using blocking treadmill sled device. More particularly, the present invention relates to a blocking treadmill that will provide training for an athlete as well as analysis of the athlete's blocking techniques and power.

BACKGROUND OF THE INVENTION

The skills that are important to a successful performance in the game of American football include blocking, charging, tackling and pass blocking. Current methods of evaluating these skills include qualitative assessments by coaches while using blocking and tackling sleds on the playing field and quantitative assessments such as the bench press, back squat, power clean and vertical jump in the gymnasium. The coaches' assessments on the playing field are not accurate due to changes in the environment, differences between observers, and the fact that these measurements are purely qualitative, while the quantitative measurements in the gymnasium are not accurate due to their non-specific nature, in that the movements are very different from the skills performed on the playing field. Therefore, it would be beneficial to develop a testing device that could simulate the resistive force of an opposing player, while accurately measuring performance when blocking, charging, tackling and pass blocking. In doing so, it would provide a more precise and reflective measure of an athlete's physical potential on the playing field and provide quantitative information that can be used when making decisions about training.

Skills that need to be evaluated include:

1. Charging. A strategic maneuver used by the defensive team to keep the offensive team from gaining yardage and scoring points. Also, strategic maneuver used by the ball carrier to gain yardage and score points.
2. Blocking. A strategic maneuver used by the offensive team to keep the defensive team away from the player carrying the ball.
3. Tackling. A strategic maneuver used by the defensive team to keep the offensive ball carrier from gaining yardage and scoring points.
4. Pass blocking. A strategic maneuver used by the offensive team to keep the defensive team away from the player passing the ball.

SUMMARY OF THE INVENTION

The treadmill sled of the present invention substantially meets the aforementioned needs by providing repeatable quantitative results that measure charging, blocking, tackling and pass blocking analysis of an athlete. In order to make such analysis, the treadmill sled of the present invention measures at least some or all of the following parameters:

1. Direction of force application.
2. Position of force application.

3. Instantaneous magnitude of force.
4. Displacement of the treadmill and the spring compensated blocking dummy.
5. Instantaneous magnitude of power output (force times distance divided by time).
6. Reaction time (the duration of time between the stimulus and the player movement).
7. Movement time (the duration of time between the player's movement and contact with an opposing object).

There is a certain rationale for measuring the above-noted quantities. With respect to the direction of force application, it is noted that when blocking, charging and pass blocking, it is advantageous to apply force in a horizontal direction (X) in the horizontal (X, Y) plane. Any force in the vertical direction (Z) will not contribute to moving the opposing player backward. Therefore, measuring the direction of the force application will determine whether changes need to be made to the block, charge, or pass blocking technique of the athlete to increase the force applied in the X direction. In addition, the force applied by the right and left hands of the athlete (such force having a component in the Y direction) may provide information about left or right dominance by either side. A weakness in one side may provide the opponent with an advantage. Measuring the amplitude of left and right force production (such force production having a component in the Y direction) will identify these weaknesses so that adjustments can be made during training of the athlete.

With respect to the measurement of position of force application, it is advantageous to apply force in the center of an opponent's mass while blocking, charging, and pass blocking. If a block or charge is applied too high on the opponent, the opponent may duck below the attempted force application and avoid being moved in the desired direction. In addition, the higher the position of force application, the greater percentage of the forces will be applied in the vertical (Z) direction as a result of the body's angle. On tackling an opposing player, it is advantageous to apply force below the center of the opponent's mass. This causes the opposing player to rotate around the player's center of mass and potentially fall to the ground. Measuring the position of force application identifies errors while performing the force application so that adjustments can be made during the athlete's training.

With respect to measuring instantaneous magnitude of force, it is advantageous to apply maximal forces through the duration of the block, charge, pass block and tackle. If the applied forces are reduced at any time, the opponent may be able to resist or avoid being moved in the desired direction. Measuring the magnitude of the force application identifies fluctuations while performing the particular maneuver so that adjustments can be made to the skill of the athlete during training.

An embodiment of the treadmill sled of the present invention further measures displacement of the treadmill and the spring compensated pad. In an isotonic mode, the belt of the treadmill and the spring of the pad mount are displaced by the forces applied by the feet and hands of the athlete. The rate at which the belt and pad are displaced depends on the amount of the opposing force provided by the treadmill braking system and the spring. Further, the amplitude and frequency of the force applied by the athlete's lever system further affects the rate. It is advantageous to displace the belt on the spring the greatest distance in the shortest period of time. The treadmill provides unlimited distance for which to block, charge, pass block or tackle. As a result, an athlete can be tested for short distances or long distances depending on the distances normally covered on the playing field.

A further measurement is the instantaneous magnitude of power output. It is advantageous to produce large and consistent power outputs while blocking, tackling, pass blocking and charging opposing players. Functional power during these skills is recorded as product of force in the X direction and displacement of the treadmill belt and blocking pad, divided by the time of execution. The amplitude of this power throughout the duration of the maneuver provides values such as impact power, maximum power, minimum power, and reduction in power from the maximum value over the time of the maneuver. These measurements are valuable in determining those athletes who are successful in these skills as opposed to those who are not so that adjustments may be made to improve certain aspects of a particular athlete's skills during training. Total power during these maneuvers is recorded as a product of force in all directions, displacement of both the treadmill and the blocking pad, divided by the time of execution of the maneuver. By measuring this quantity, the efficiency of the athlete's skill can be calculated. Efficiency is the product of functional power divided by the total power.

The device of the present invention further measures reaction time. It is advantageous to begin movement toward an opposing player in the shortest amount of time possible after the auditory or visual stimulus indicating initiation of contact. Players with shorter reaction times potentially make contact with their opponents at higher velocities, thereby resulting in greater power outputs directed to the opponent.

Additionally, it is desirable to measure movement time. It is advantageous to cover greater distances in shorter periods of time before making contact with the opponent while blocking, charging, and tackling. Players with shorter movement times potentially make contact with an opponent at higher velocities resulting in greater power outputs. Deficiencies noted in movement time can be corrected through changes in the skill technique of the player and in practicing the skill.

The present invention is a method and apparatus for assessing a user athlete's prowess at certain athletic skills , the apparatus being treadmill sled having a frame, a rotatable continuous belt mounted on the frame, the belt presenting an upward directed support surface for supporting a user athlete, a blocking dummy supported proximate the continuous belt and being operably coupled to the frame by a dummy support, and a performance measuring system.

DETAILED DESCRIPTION OF THE DRAWINGS

Figure 2:
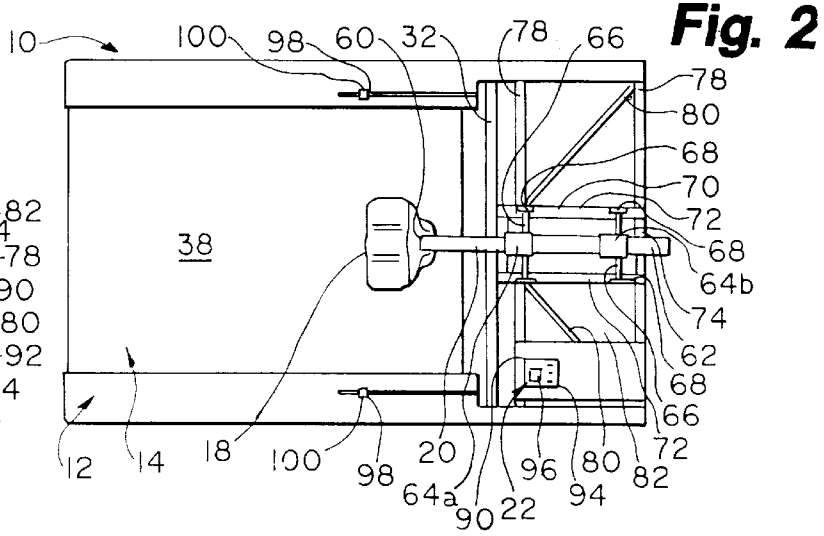
FIG. 2 is a top plan form view of the blocking sled.

The treadmill sled of the present invention is shown generally at 10. In each of the embodiments, the treadmill sled 10 includes the following major components:

Frame 12, treadmill 14, treadmill control system 16, blocking dummy 18, dummy support 20, and performance measurement system 22. In each of the embodiments of the treadmill sled 10, common components will be referred to with like numerals.

A first embodiment of the treadmill sled 10 is depicted in FIGS. 1–8. The frame 12 of the treadmill sled 10 has a pair of spaced apart, generally parallel side supports 30 that extend from the front to the rear of the treadmill sled 10. The side supports 30 are fixedly coupled together by a plurality of lateral supports 32 that extend between the two spaced apart sides supports 30 and are fixedly coupled thereto. A plurality of downward directed pads 34 are provided at the lower margin of the side supports 30 for engaging the surface on which the treadmill sled 10 is supported. The pads 34 are most useful when the treadmill sled 10 is disposed within a building and resting on a floor as distinct from being positioned on a practice field on a soil or other underlying surface.

Figure 1:
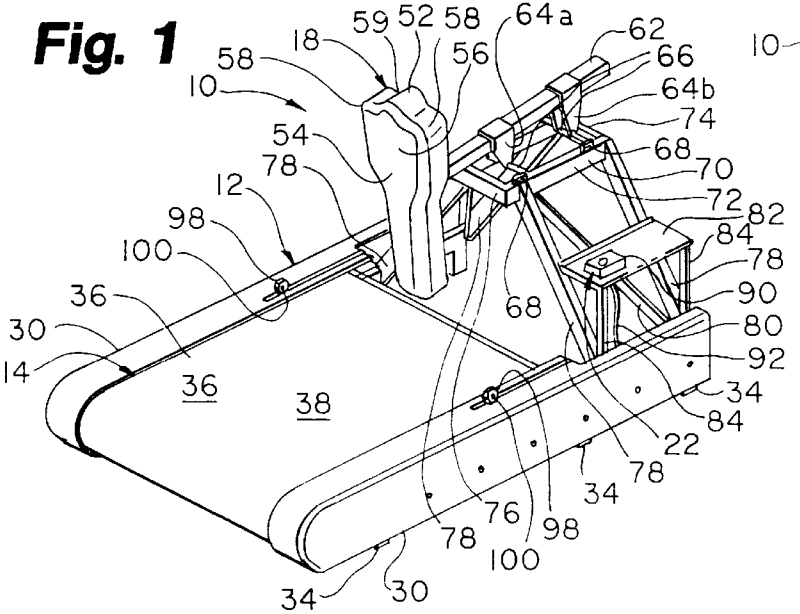
FIG. 1 is a perspective view of a first embodiment of the blocking sled of the present invention.
Figure 4:
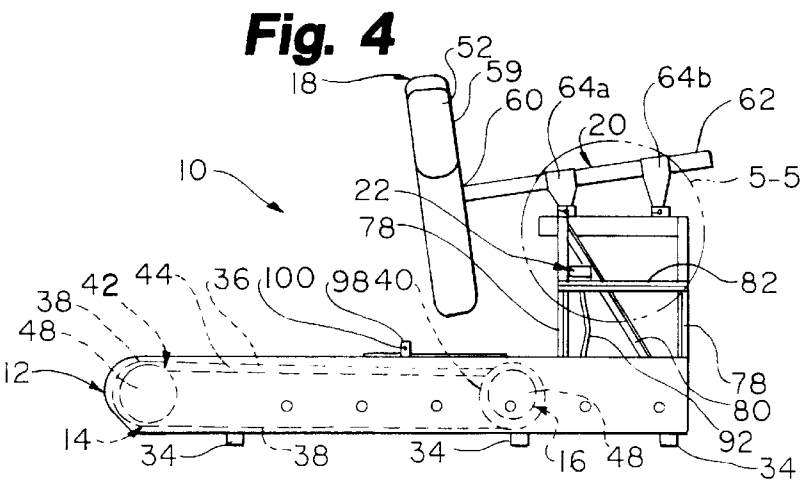
FIG. 4 is a side elevational view of the blocking sled.
Figure 3:
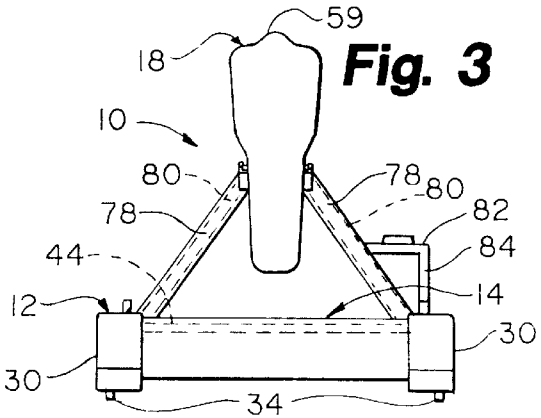
FIG. 3 is an elevational view of the blocking sled looking toward the contact surface of the blocking dummy.
Figure 5:
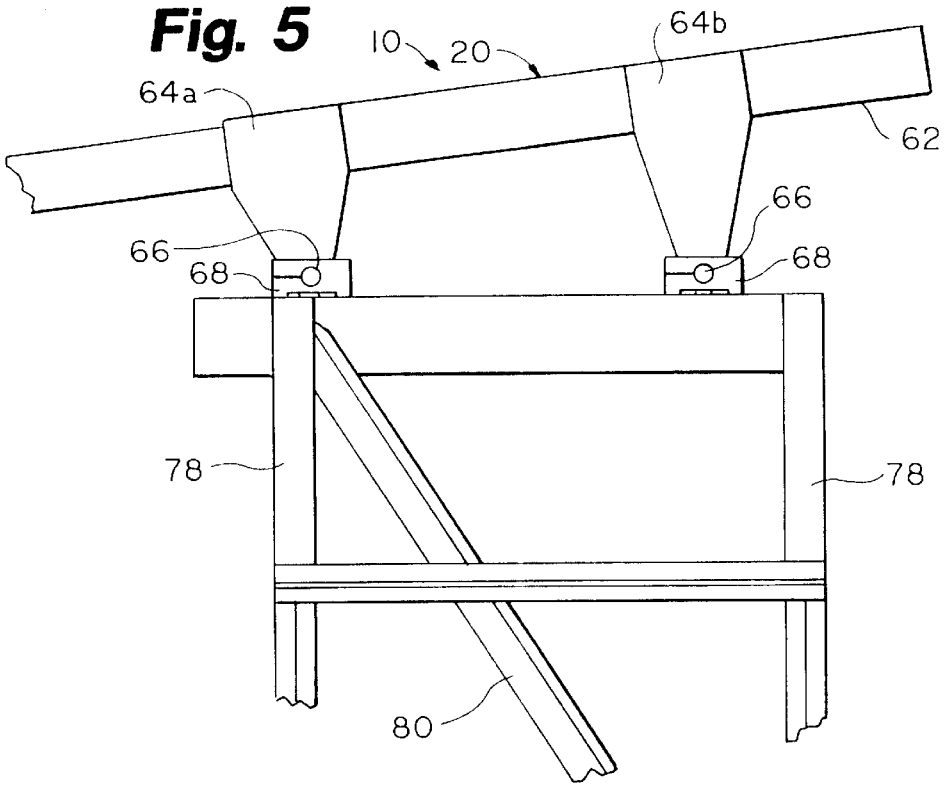
FIG. 5 is a side prospective view of common attachment points taken along the circle 5—5 of FIG. 4.
Figure 6:
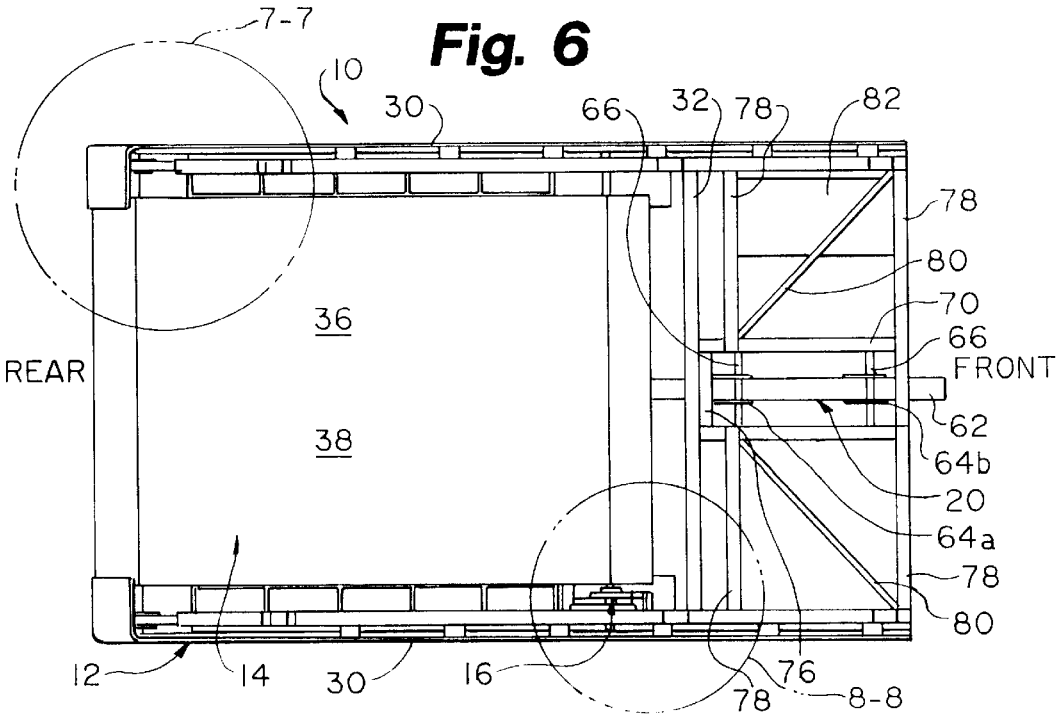
FIG. 6 is a bottom plan form view of the blocking sled.

The treadmill 14 of the treadmill sled 10 includes a continuous belt 36. The continuous belt 36 has an upward directed support surface 38 as depicted in FIGS. 1 and 2. The support surface 38 is directed downward on the return leg of the continuous belt 36 as viewed from the underside of the treadmill sled 10 in the depiction of FIG. 6.

The continuous belt 36 is supported at least on a first roller 40 and a spaced apart second roller 42. Each of the rollers 40, 42 is supported on a roller axle 46, the roller axle 46 being borne in suitable bushings and being operably coupled to the respective side supports 30. An underlayment support 44 may be positioned immediately beneath the underside of the advancing portion of the continuous belt 36 to assist in supporting an athlete on the continuous belt 36. In practice, the continuous belt 36 slides across the upward directed surface of the underlayment support 44 when the continuous belt is rotated about the rollers 40, 42. The underlayment support 44 is depicted in phantom in FIGS. 3 and 4.

The third component of the treadmill sled 10 is the treadmill control system 16. The treadmill control system 16 is best viewed in FIGS. 6–8. The treadmill control system 16 includes a disk brake 48 mounted on the axle 46 of the first roller 40. The disk brake 48 has a variable caliper 50 that is variably engageable with the disk brake 48. The variable caliper 50 may be manually adjusted in order to increase or decrease the amount of resistance that the first roller 40 transmits through the rotatability of the continuous belt 36. Accordingly, increasing the tension that the variable caliper 50 exerts upon the disk brake 48 directly effects the amount of driving effort that an athlete must impart to the continuous belt 36 in order to cause the continuous belt 36 to rotate about the rollers 40, 42.

Figure 7:
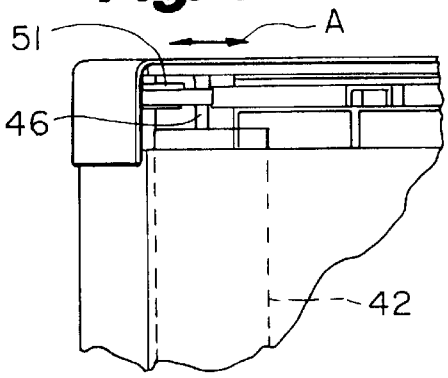
FIG. 7 is a bottom plan form of the belt tension adjustment as depicted in the circle 7—7 of FIG. 6.
Figure 8:
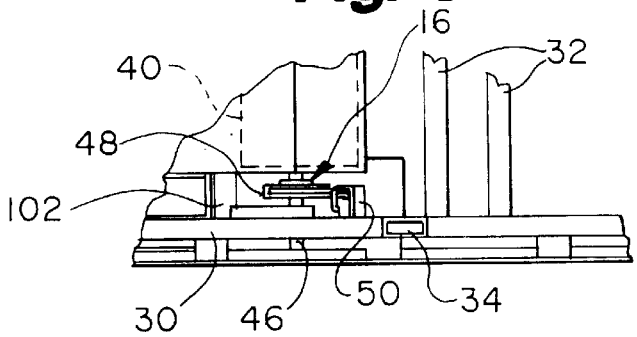
FIG. 8 is a bottom plan form view of the belt brake as depicted in the circle 8—8 of FIG. 6.

A threaded tension adjuster 51 is operably coupled to the roller axle 46 of the second roller 42. Tension adjuster 51 directly effects the fore and aft disposition of the roller axle 46 relative to the frame 12. By rotating the threaded tension adjuster 51, the roller axle 46 of the second roller 42 is moved as depicted by arrow A of FIG. 7. Moving the rolling axle 46 rearward (leftward) as depicted in FIG. 7 acts to increase the distance between the rollers 40, 42, thereby increasing the tension on the continuous belt 36.

The fourth component of the treadmill sled 10 is the blocking dummy 18. The blocking dummy 18 may be a conventional blocking dummy having a canvass exterior enclosing a resilient foam interior. The blocking dummy 18 has a impact body 52. The impact body 52 presents a rearward facing contact surface 54. The contact surface 54 is preferably generally shaped in the shape of an opposing athlete, having a torso 56 and shoulders 58. Other shapes of the impact body 52 may also be used, for example, a generally vertically disposed tubular body or a generally horizontally disposed tubular body. The impact body 52 may be mounted on a planar support 59. The planar support 59 may have an outer margin that is roughly the shape of the side margin of the impact body 52.

The fifth components of the treadmill sled 10 is the dummy support 20. The dummy support 20 of the present embodiment of the treadmill sled 10 includes an elongate beam 62. The beam 62 is fixedly coupled at the distal end by a single point attachment 60 to the planar support 59 of the blocking dummy.

The beam 62 has a pair of depending brackets 64*a*, 64*b*. The bracket 64*a* is more rearwardly disposed than the bracket 64*b* and has a lesser height dimension than the bracket 64*b*. The variance in height dimension of the brackets 64*a*, 64*b* effects an incline in the beam 62, the incline declining in a rearward direction toward the distal end of the beam 62. The brackets 64*a*, 64*b* are fixedly removably coupled to respective spaced apart receivers 68 by cross pins 66 that pass through bores defined in a respective pair of receivers 68 and a respective bracket 64*a*, 64*b*. The two pairs of receivers 68 are mounted on a box frame.

The box frame 70 includes a pair of spaced apart and generally parallel side rails 72. The side rails 72 are operably coupled together by an end rail 74 and a front rail 76 to define the generally rectangular shape of the box frame 70. There are two of the receivers 68 disposed on each of the two side rails 72.

Four angular supports 78 rise to support the box frame 70. A first end of each of the angular supports 78 is coupled to a respective side support 30 at a second end of each of the angular supports 78 is fixedly coupled to the box frame 70. A pair of braces 80 rise to the box frame 70 to counter the force exerted by an athlete on the blocking dummy 18. A first end of each of the braces is fixedly coupled to a respective side support 30 proximate the front margin of the respective side support 30. Each of the braces 80 rise to a point proximate the point of connection of the rearwardmost angular support 78 with the box frame 70 and are fixedly connected to the box frame 70 proximate such point of connection.

A tray 82 is disposed on a side of the dummy support 20. The tray 82 is supported at an outer margin by a pair of depending tray legs 84. The lower margin of the tray legs 84 is affixed to the upper margin of a side support 30.

The final major element of the treadmill sled 10 is the performance measurement system 22. In its simplest form in the embodiment of FIGS. 1–8, the performance measurement system 22 includes a controller 90 disposed on the upward directed surface of the tray 82. The controller 90 may be connected by a plurality of depending leads 92 to a plurality of sensors, as will be described. The controller 90 includes actuating switches 94 and a readout 96.

In the embodiment of FIGS. 1–8, the treadmill sled 10 has three sensors utilized for evaluating the performance of an athlete using the treadmill sled 10. First, the variable caliper 50 can be utilized to apply friction to the disk brake 48 to increase or decrease the resistance to motion that is available in continuous belt 36. In conjunction with that, a laser beam 98 provides an output related to the position of the using athlete's hands when in contact with the contact surface 54 of the impact body 52. A photoelectric cell 100 indicates when the user athlete's hands have commenced contact with the impact body 52. When used in conjunction with an auditory command given simultaneously with electing initiation of a timer with an actuating switch 94, the photoelectric cell 100 gives an indication of the reaction of the user athlete.

A further sensor is a rotary encoder 102. The rotary encoder 102 is in contact with the continuous belt 36 and provides an output to the readout 96 that is indicative of the distance traveled by the continuous belt 36 during the blocking maneuver executed by the using athlete.

Figure 9:
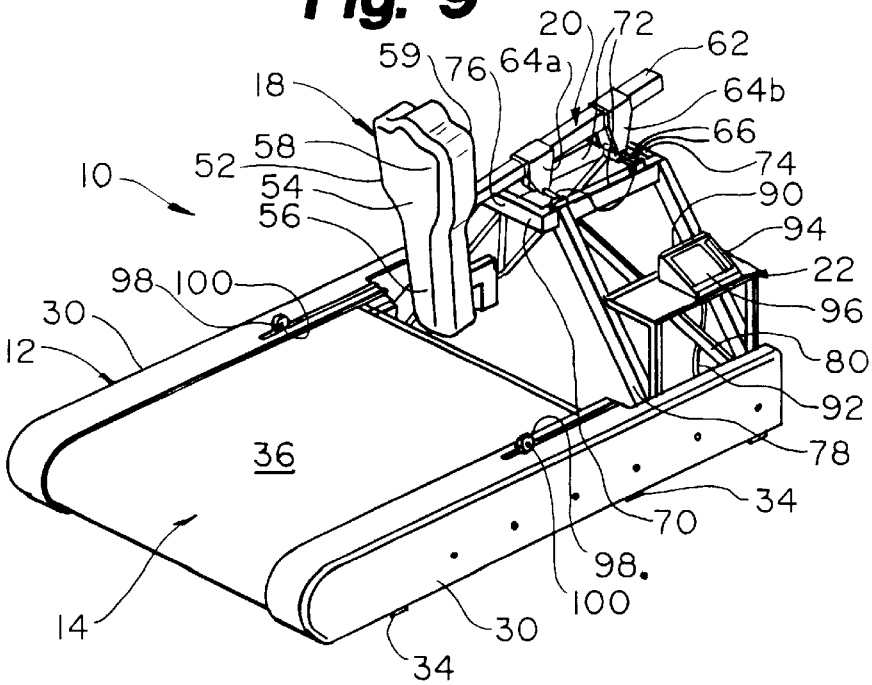
FIG. 9 is a perspective view of a second embodiment of the blocking sled of the present invention.
Figure 11:
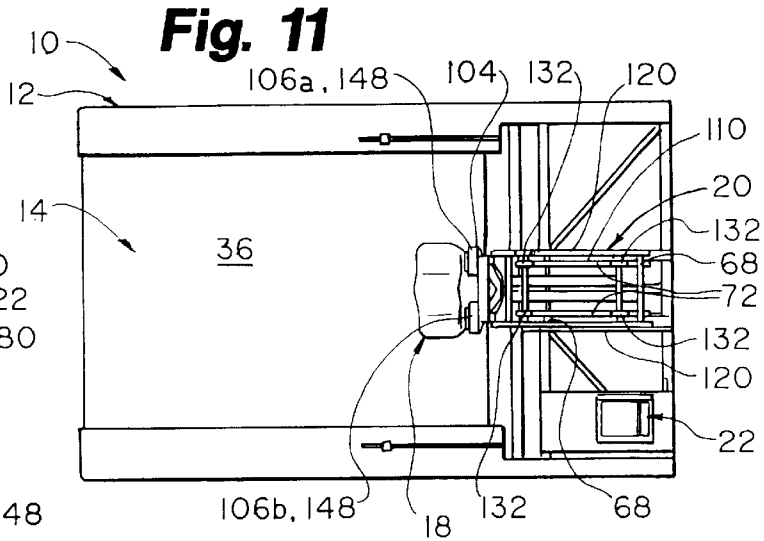
FIG. 11 is a top plan form view of the embodiment of FIG. 10.
Figure 10:
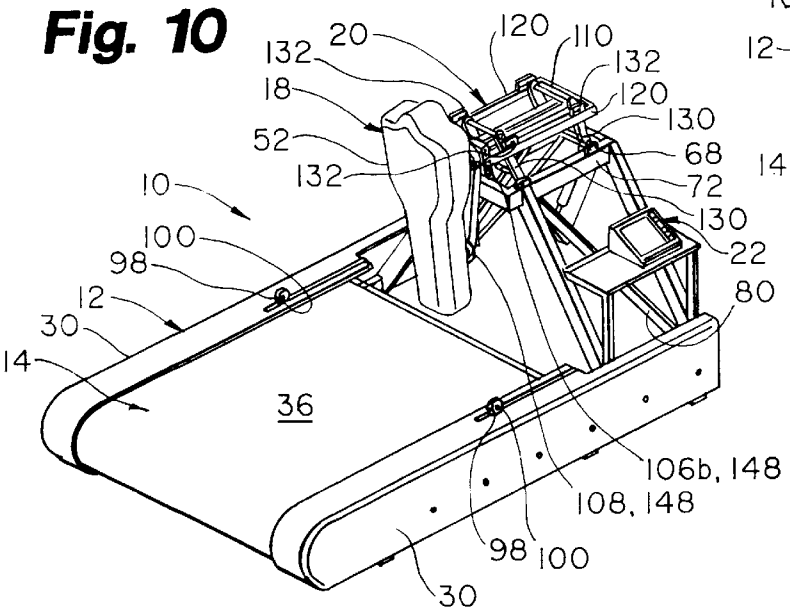
FIG. 10 is a perspective view of a third embodiment of the present invention.
Figure 13:
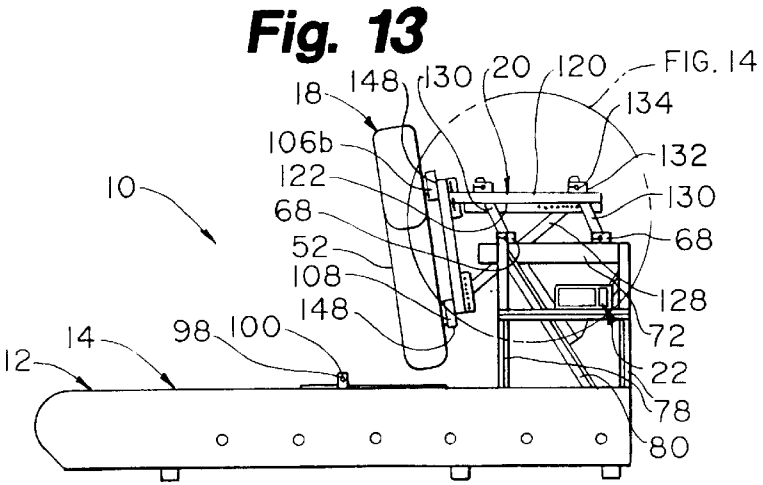
FIG. 13 is a side elevational view of the embodiment of FIG. 10.
Figure 12:
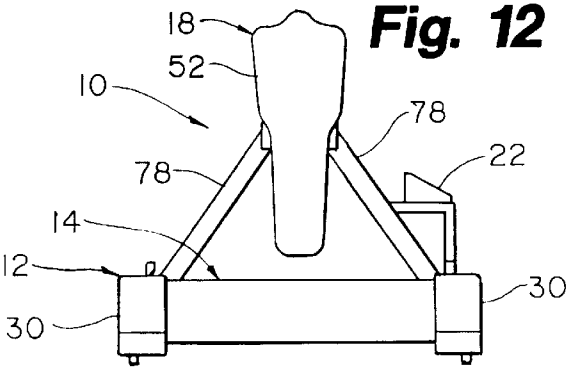
FIG. 12 is an end elevational view taken facing the blocking surface of the blocking dummy.
Figure 14:
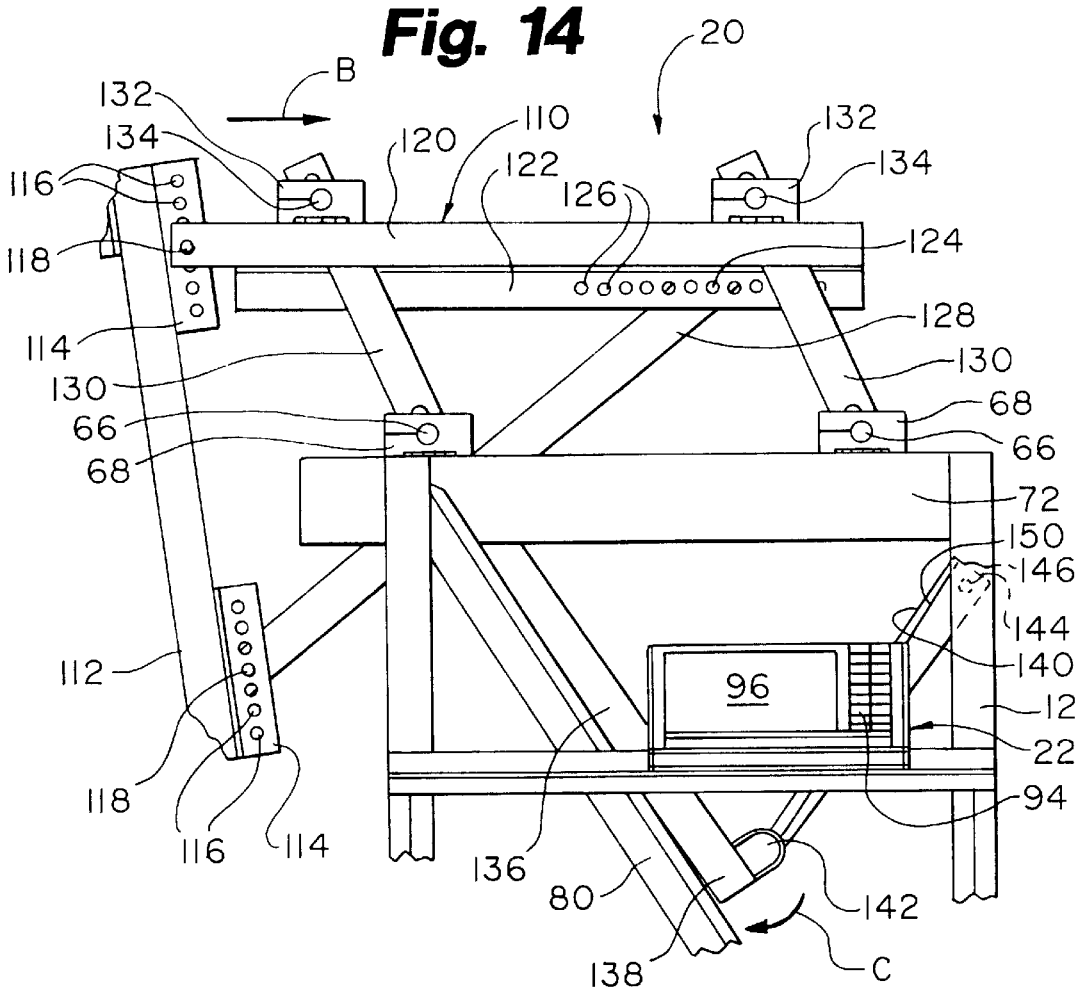
FIG. 14 is a side elevational view taken along the circle 14—14 of FIG. 13.
Figure 16:
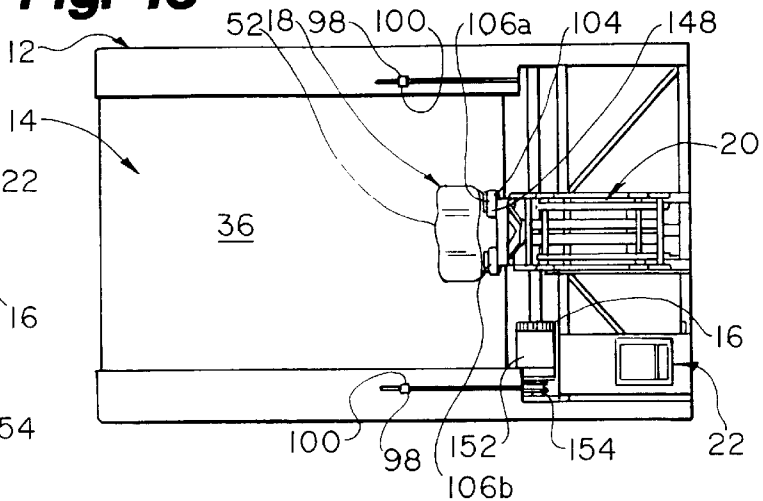
FIG. 16 is a top plan form view of the embodiment of FIG. 15.
Figure 17:
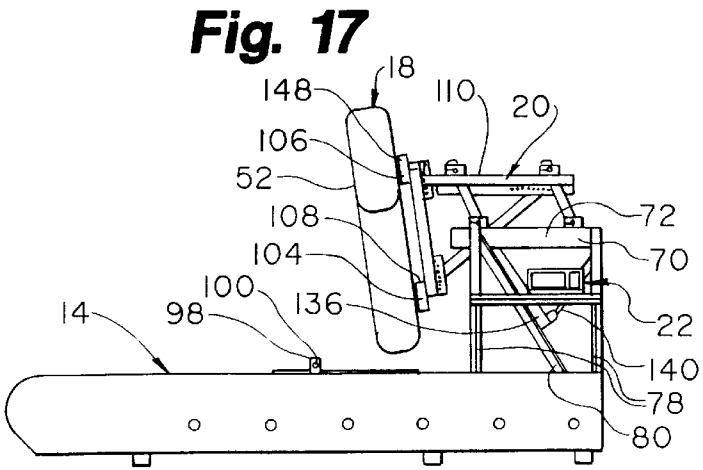
FIG. 17 is a side elevational view of the embodiment of FIG. 15.
Figure 15:
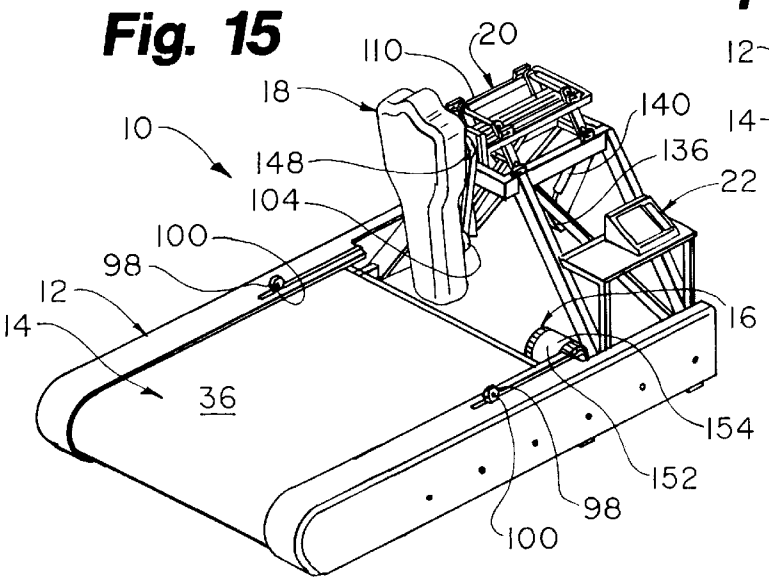
FIG. 15 is a perspective view of a fourth embodiment of the present invention.
Figure 18:
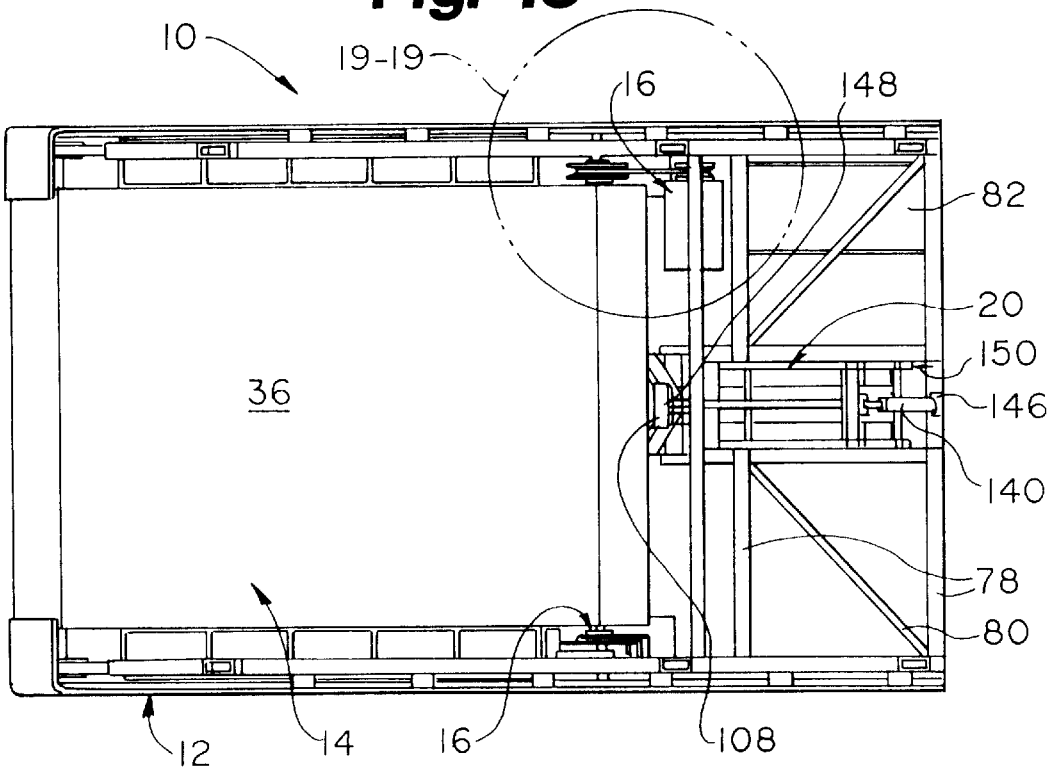
FIG. 18 is a bottom plan form view of the embodiment of FIG. 15.
Figure 19:
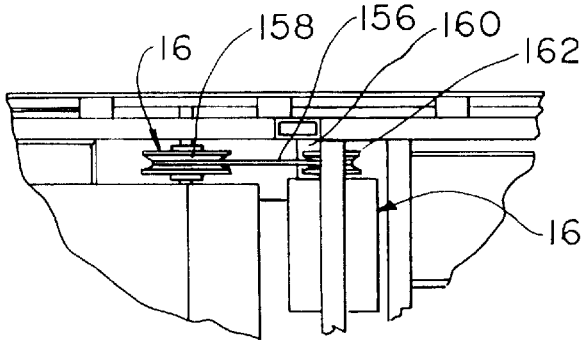
FIG. 19 is a bottom plan form view of the motor and drive assembly taken along circle 19—19 of FIG. 18.
Figure 20:
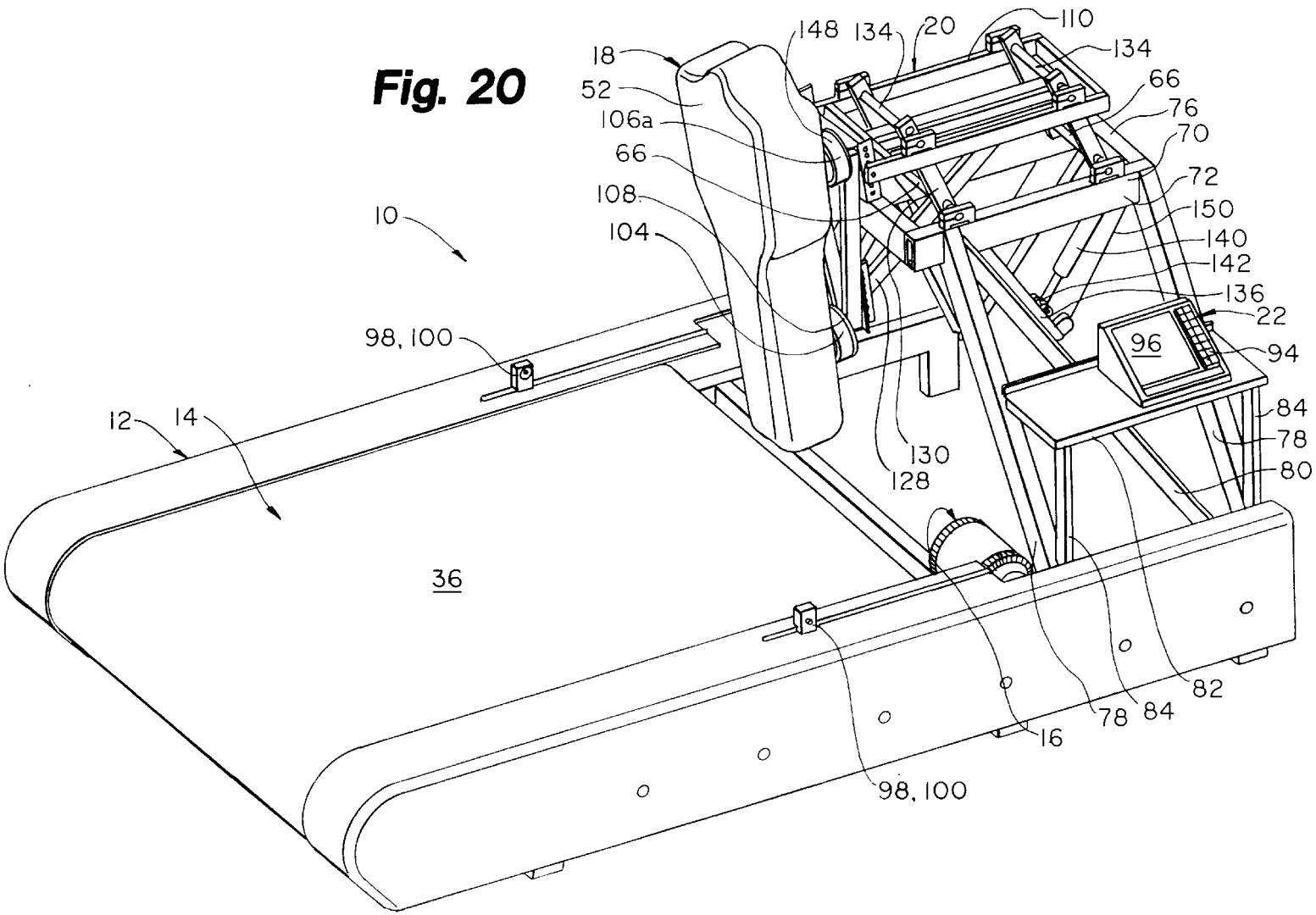
FIG. 20 is a perspective view of the embodiment of FIG. 15.
Figure 21:
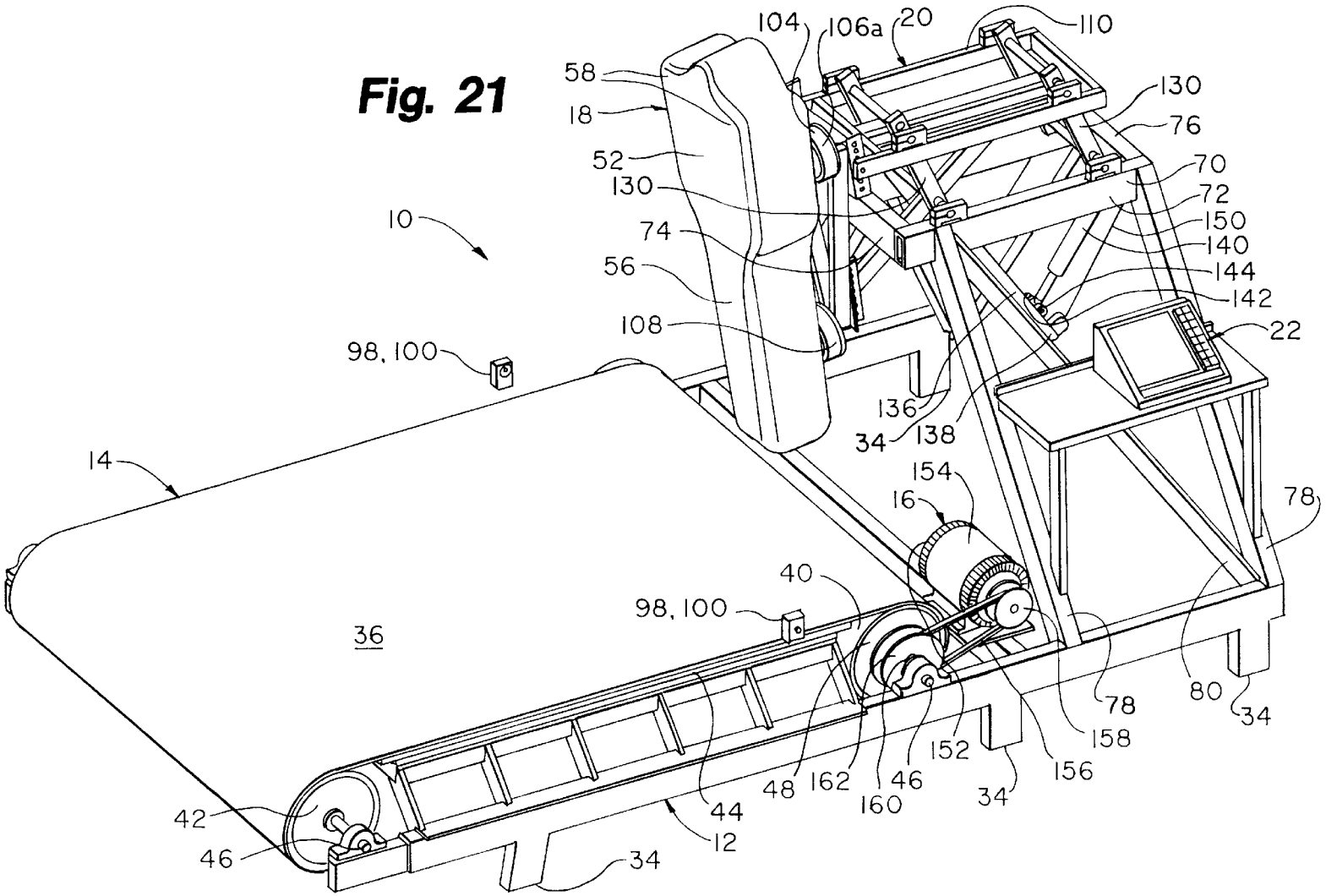
FIG. 21 is a side elevational view with components broken away to reveal the treadmill and drive components.

A second embodiment of the treadmill sled 10 of the present invention is depicted in FIG. 9. The treadmill sled 10 of FIG. 9 includes an enhanced controller 90 having a processor for calculating selected parameters based on sensed quantities. The braking system including the disk brake 48 and variable caliper 50 is used to estimate force production of a user athlete. A calibration procedure is conducted by the controller 90 to determine the force required to rotate the friction loaded disk brake 48. As a result of applying a regression equation, the pressure applied by the variable caliper 50 to the disk brake 48 is utilized to predict the force required to rotate the continuous belt 36 of the treadmill sled 10. After varying the pressure applied to the disk brake 48, a second experiment may be conducted to estimate the force required to turn the belt 36 of the treadmill sled 10. These values used in conjunction with the treadmill displacement as measured by the rotary encoder 102 and the time over which the displacement was effected results in an estimation of power output.

A third embodiment of the treadmill sled 10 is depicted in FIGS. 10–14. A major difference between this embodiment of the treadmill sled 10 and the previous two embodiments of the treadmill sled 10 is found in the dummy support 20.

The dummy support 20 here includes a three point attachment 104 for supporting the blocking dummy 18. The three point attachment 104 includes two spaced apart shoulder attachments 106*a*, 106*b* and a lower torso attachment 108. The three point attachment 104 is fixedly coupled to a shiftable support frame 110.

The shiftable support frame 110 includes a subframe 112 for direct coupling to three point attachment 104. The subframe 112 has at least two flanges 114, the flanges 114 having a plurality of adjusting holes 116 defined therein. By selecting the desired adjusting hole 116 on the flanges 114, the relative height of the blocking dummy 118 can be adjusted as desired.

The upper flange 114 is fixedly coupled to a horizontal support 120 by a pin 118.

The horizontal support 120 has depending flange 122 fixedly coupled to the underside margin thereof. The depending flange 122 has a plurality of holes 126 defined therein. A pin 124 disposed in a selected hole 126 may be coupled to a rising support 128. By selecting a desired hole 126 for coupling with the rising support 128, the angle of the blocking dummy 18 can be adjusted relative to a vertical disposition.

The rising support 128 is coupled at a first end to the flange 122 as indicated above. The rising support 128 is coupled at a second end to the lower flange 114 by a pin 118.

The shiftable support frame 110 further includes a pair of parallel pivoting arms 130. The pivoting arms 130 are pivotally connected to a respective receiver 132 mounted on the upper margin of the horizontal support 120 by pins 134. The respective parallel pivoting arms 130 are pivotally coupled at a second end to a respective receiver 68 by cross pins 66.

With the aforementioned structure, the side rail 72, the horizontal support 120 and the parallel pivoting arms 130 function as a shiftable parallelogram. A force imparted to the blocking dummy 18 will cause this parallelogram to shift as indicated by the arrow B in FIG. 14.

A depending moment arm 136 is fixedly coupled to the shiftable support frame 110. The moment arm 136 is coupled at a distal end 138 to a spring 140 by a pivotal coupling 142. The spring 140 is further pivotally coupled at a second end by a pin 144 forming a pivotal coupling 146 with the frame 12.

Motion as indicated by the arrow B that is imparted to the shiftable support frame 110 results in a rotation of the moment arm 136 as indicated by the arrow C. Accordingly, the motion indicated by arrow B is resisted by the bias exerted by the spring 140 on the distal end 138 of the moment arm 136.

The motion of arrow B results in a measurable extension of the spring 140. Accordingly, an extension sensor 150 may be utilized in conjunction with the spring 140. Additionally, individual force sensors 148 may be associated with each of the attachments 106*a*, 106*b*, and 108 of the three point attachment 104.

With the third embodiment of the treadmill sled 10, the extension sensor 150 is utilized to estimate force production of a user athlete exerting a force on the blocking dummy 18. As a result of applying the regression equation, the linear displacement through extension or lengthening of the spring 140 by the force exerted by the user athlete is utilized to estimate the force required to effect such extension. This value plus the spring displacement, treadmill displacement, and time of exerting the force results in an estimate of power output by the user athlete.

Force exerted by the user athlete is directly measured as close as possible to where the user athlete impacts the blocking dummy 18, thereby resulting in no significant losses into the supporting structure. This is accomplished with the multi-axis force sensors 148 associated with the attachments 106*a*, 106*b*, and 108. These three force sensors 148 are kinematically mounted so that their measurements can be added to obtain the resultant forces and moments. Unlike existing field sleds used in practice, the treadmill sled 10 of the present invention provides an inertial reference frame in which the magnitudes and directions of the forces exerted by the user athlete can be directly measured. Instantaneously measuring the forces at all three of the force sensors 148 provides the data necessary to calculate the position of the applied forces with respect to the blocking dummy 18, their magnitude, and their directions.

Further, displacement of the continuous belt 36 is measured by the rotary encoder 102. Displacement of the spring 140 is measured by the extension sensor 150. The signal received from the foregoing sensors are collected and processed by a data acquisition card and processor in the controller 90. An actuating switch 94 triggers the start of data acquisition. The photoelectric cell 100 indicates the user athlete's initial movement and an internal clock in the controller 90 keeps track of time expended throughout an evolution. By reading the forces, displacements, and time, the controller 90 calculates the resulting output and displays on the readout 96.

The fourth embodiment of the treadmill sled 10 is depicted in FIGS. 15–21. A major addition to this embodiment as compared to the previous three embodiments is the inclusion of a power system 152. The power system 152 in its simplest forms includes an electric motor 154 that is operably coupled to a belt drive 156. The belt drive 156 is rotatably engaged with a pulley 158 that a fixedly coupled to the roller axle 46 of the first roller 40. Operation of the electric motor 154 acts to impart a rotational motion to the first roller 40, the first roller 40 acting on the continuous belt 36 to cause rotation thereof.

In a more sophisticated mode, the pulley 158 and the pulley 162 mounted on the output shaft of the electric motor 154 comprise a variable speed transmission 160 by cooperatively varying the effective diameter of the two pulleys 158, 162, the variable speed transmission 160 can effect a substantially infinite variable velocity of the continuous belt 36 while maintaining the rotational output of the electric motor 154 at substantially a constant revolutions per minute.

With the addition of the power system 152, the number of additional modes of operation of the treadmill sled 10 are possible. The first of such modes is the isokinetic mode of operation. In this mode, the treadmill belt 36 is driven at a constant velocity by the power system 152. Force is measured while performing blocking, charging, and tackling. User athletes are evaluated for their ability to apply forces at various velocities of the continuous belt 36. Different positions manned by the user player require testing and training at different velocities depending on the movement patterns normally performed by a player manning that position.

The second mode is isotonic. In this mode, a constant resistance is applied to the continuous belt 36 by the tension adjuster 51 acting on the variable caliper 50. The velocity of the belt 36 is free to change depending on the amplitude and frequency of the force supplied by the user athletes force supplied to the belt 36. The athlete user is then evaluated for the ability to block, charge, and tackle at various treadmill belt 36 resistances.

The final mode of operating is matching speed to maintain force production. In this mode of operation, force applied to the pad remains constant throughout the block, charge, or tackle. The controller 90 acts to increase or decrease the speed of the belt 36 by its control over the variable speed transmission 160 depending upon the amount of force applied to the pad. To increase force production, controller 90 lowers the velocity of the belt 36 and to reduce the force production, the processor 90 increases the velocity of the belt 36.

A further somewhat unrelated mode of operation is that utilized for pass blocking. In pass blocking, the offensive player is required to execute a series of back-pedaling movements interspersed with explosive contacts with the charging defensive player, while trying to remain positioned between the defensive player and the ball carrier. To simulate this skill on the treadmill sled 10, the isokinetic mode, described above, is utilized with the belt 36 turning in the opposition direction than would be used for the modes described above. The belt 36 travels at a constant velocity. The athlete user performs this back-pedaling motion to match the speed of the treadmill belt 36. An auditoric or visual stimulus to the user athletes signals when to make an explosive contact with the blocking dummy 18 (the pad), after which the user athlete returns to the back-pedaling movement. This is repeated for a number of times during a period of time lasting approximately 10 seconds. The force amplitude is measured for each contact with the blocking dummy 18.

Figure 22:
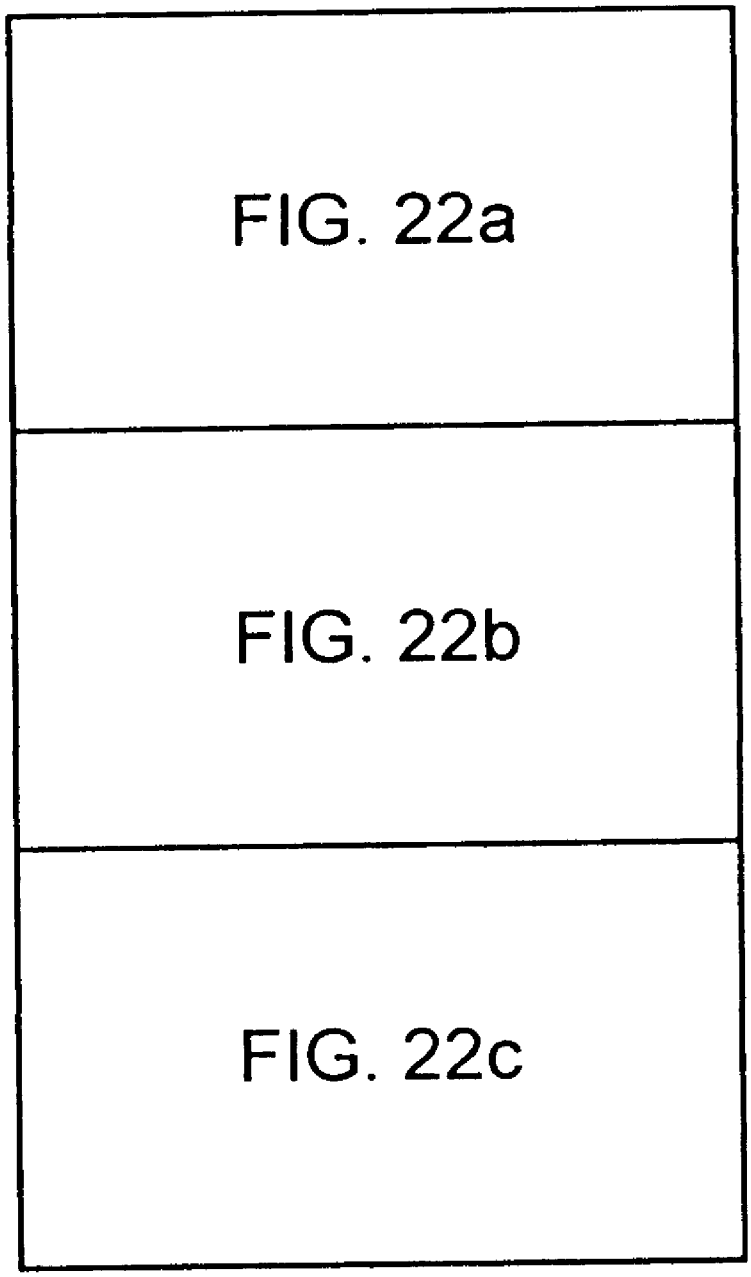
FIG. 22 is a schematic diagram of the program implemented on the embodiment of FIGS. 15 and 23.
Figure 22A:
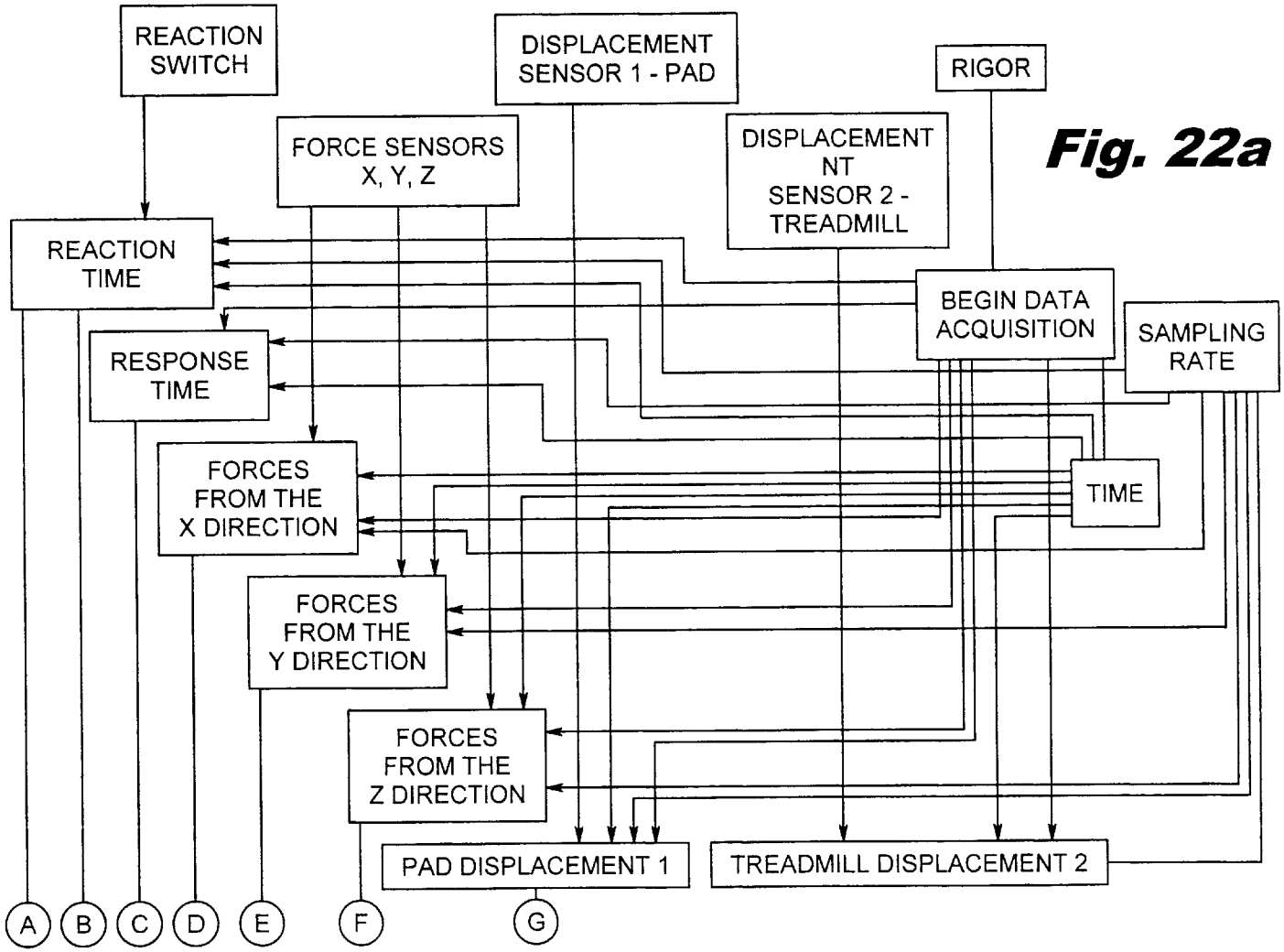
Figure 22B:
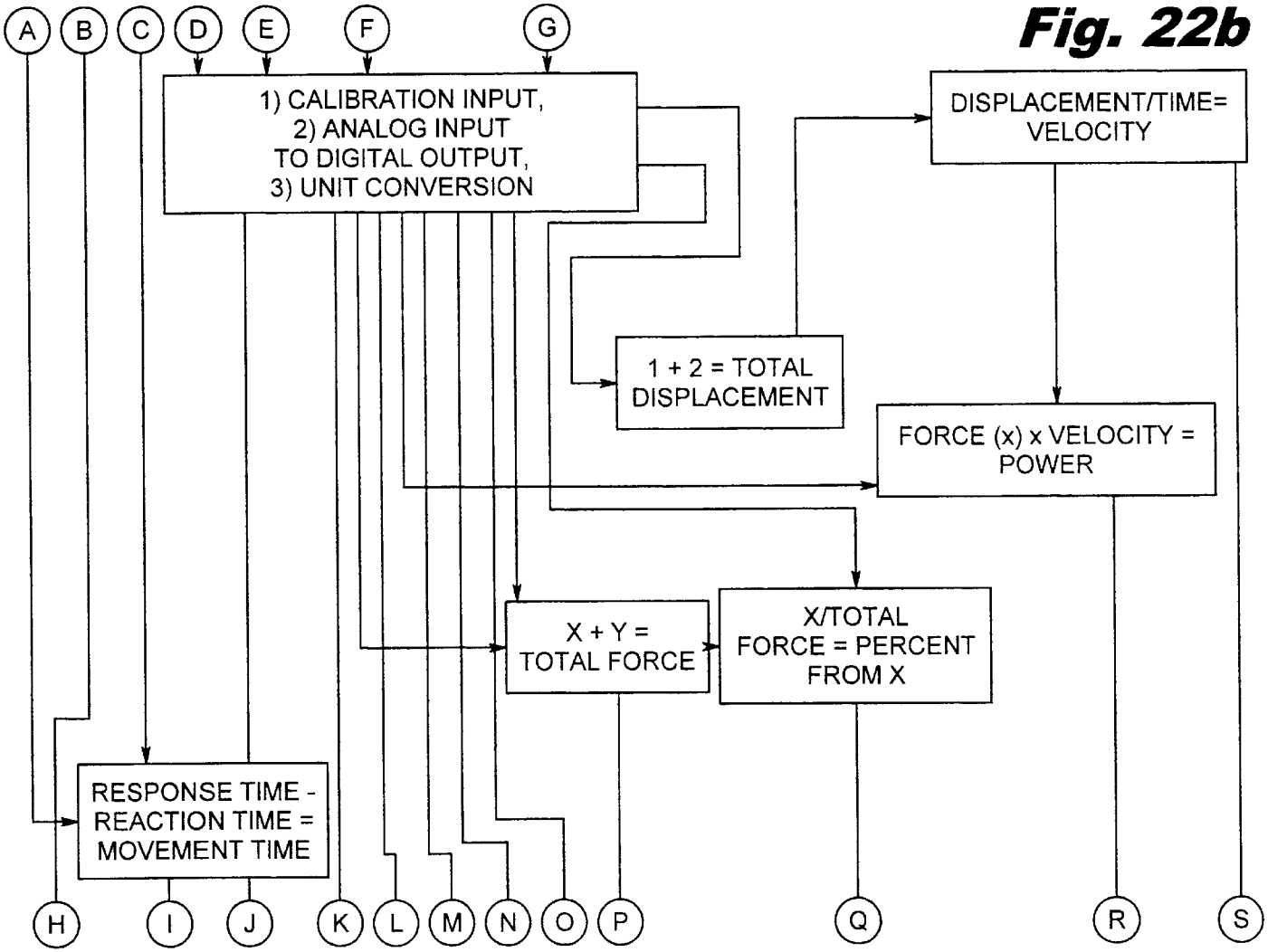
Figure 22C:
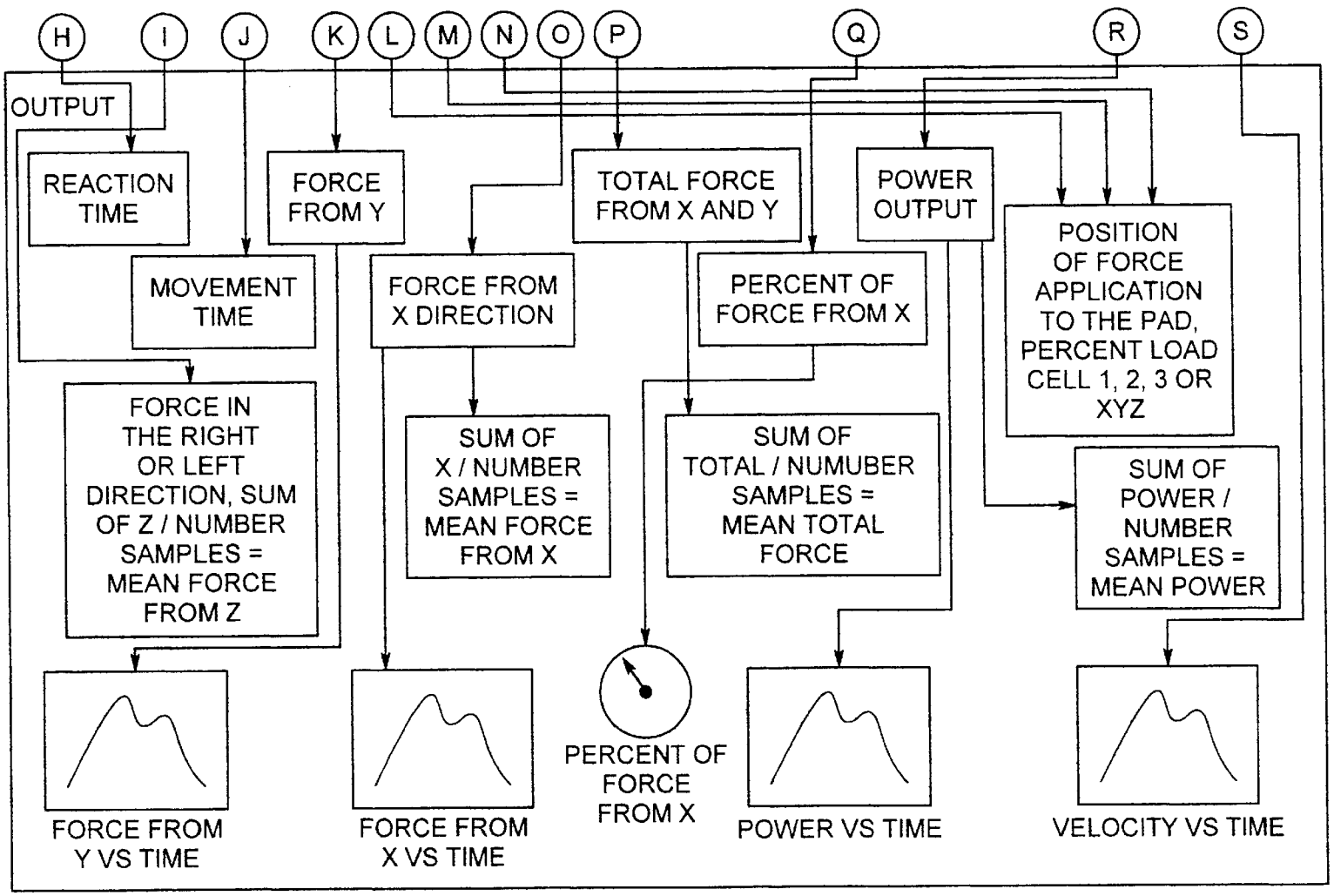
Figures 23, 24A:
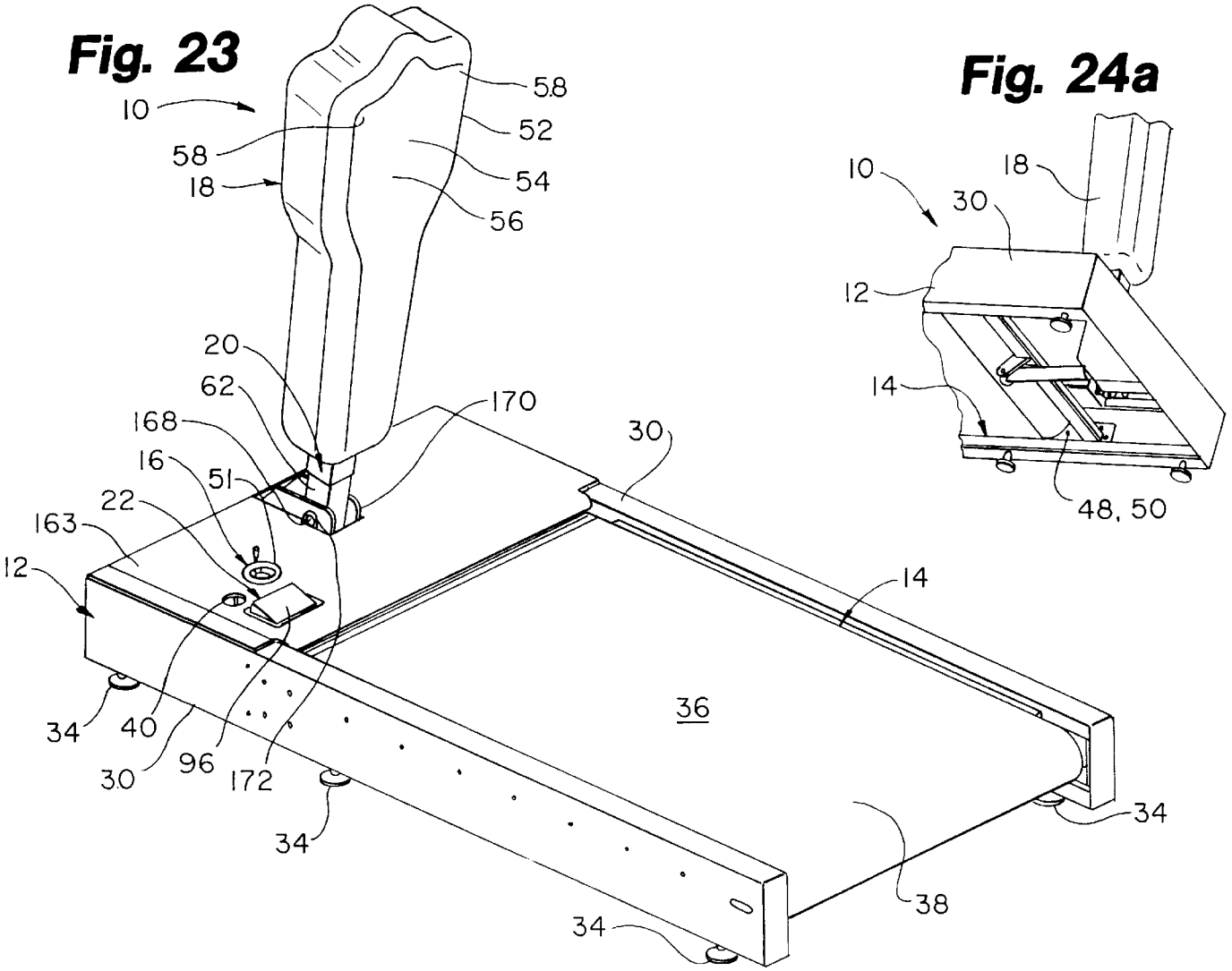
FIG. 23 is a perspective view of a further embodiment of the present invention.
FIG. 24*a* is a fragmentary bottom perspective view of a portion of the embodiment of FIG. 23.
Figure 24:
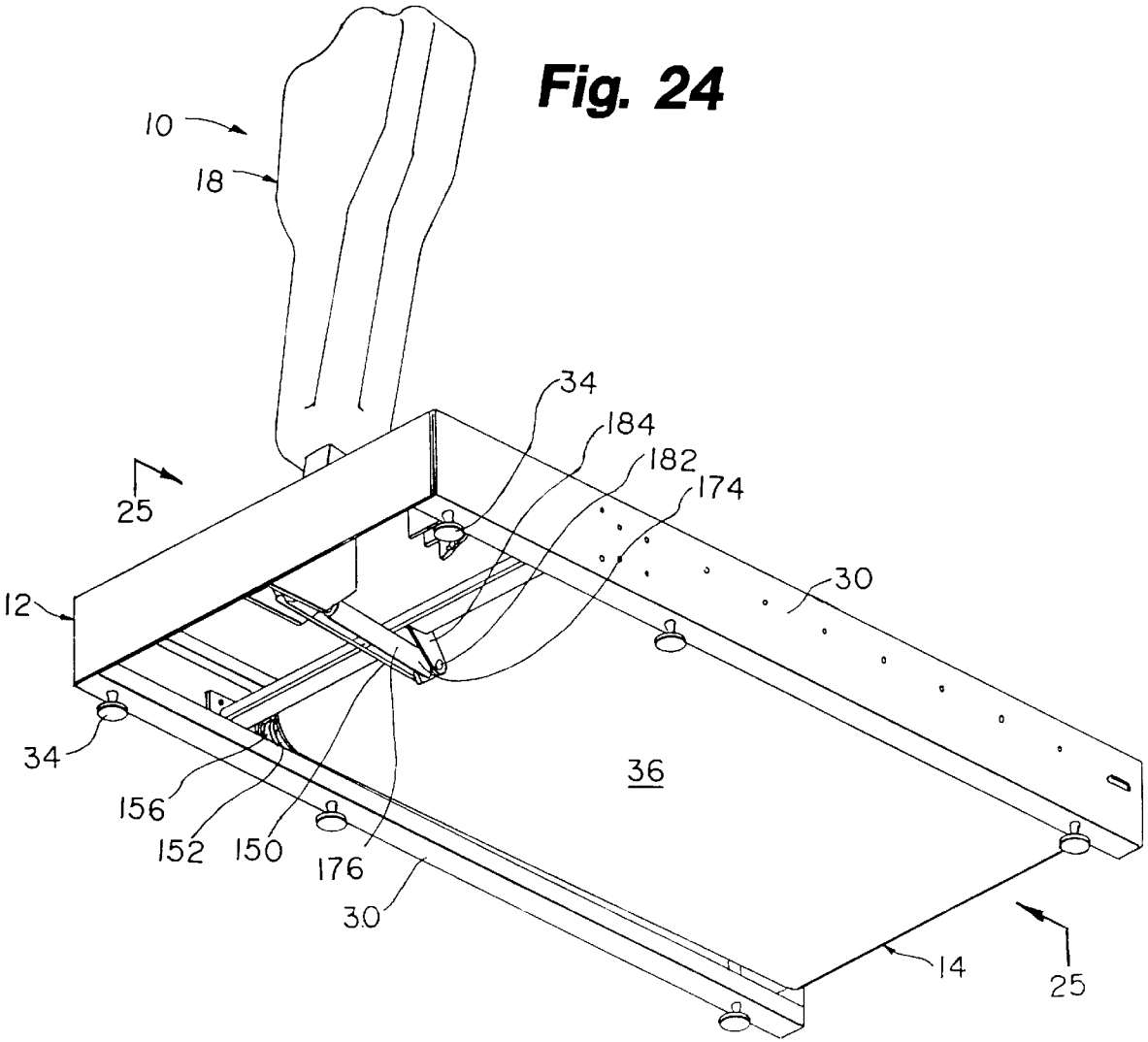
FIG. 24 is a bottom perspective view of the embodiment of FIG. 23.

FIG. 22 applies principally to the fourth embodiment described above. The controller, which includes a processor, performs the calculations detailed in FIG. 22 to arrive at a number of useful outputs that relate to the ability of the user athlete. The outputs are depicted in the output box at the lower portion of the figure. The graphic representations may be presented to the operator of the treadmill sled 10 on the readout 96 and may further get recorded for tracking of a particular user athlete's performance over a number of different sessions on the treadmill sled 10.

A further embodiment of the present invention is depicted in FIGS. 23–26. The design of FIGS. 23–26 was made in order to retain all the functions of the aforementioned designs yet reduce the mass and size of the treadmill sled 10. In order to accomplish this, the treadmill sled 10 substantially reconfigured. A platform 163 extends between the side supports 30 forward of the leading edge of the continuous belt 36. Controls and readouts for the performance measurement system 22 are positioned on the platform 163. The readout 96 is slightly elevated from the platform 163 and inclined toward the athlete user of the treadmill sled 10. It is further disposed toward a side of the treadmill sled 10 so that a coach or other monitoring individual can readily view the information presented on the readout 96.

Figure 25:
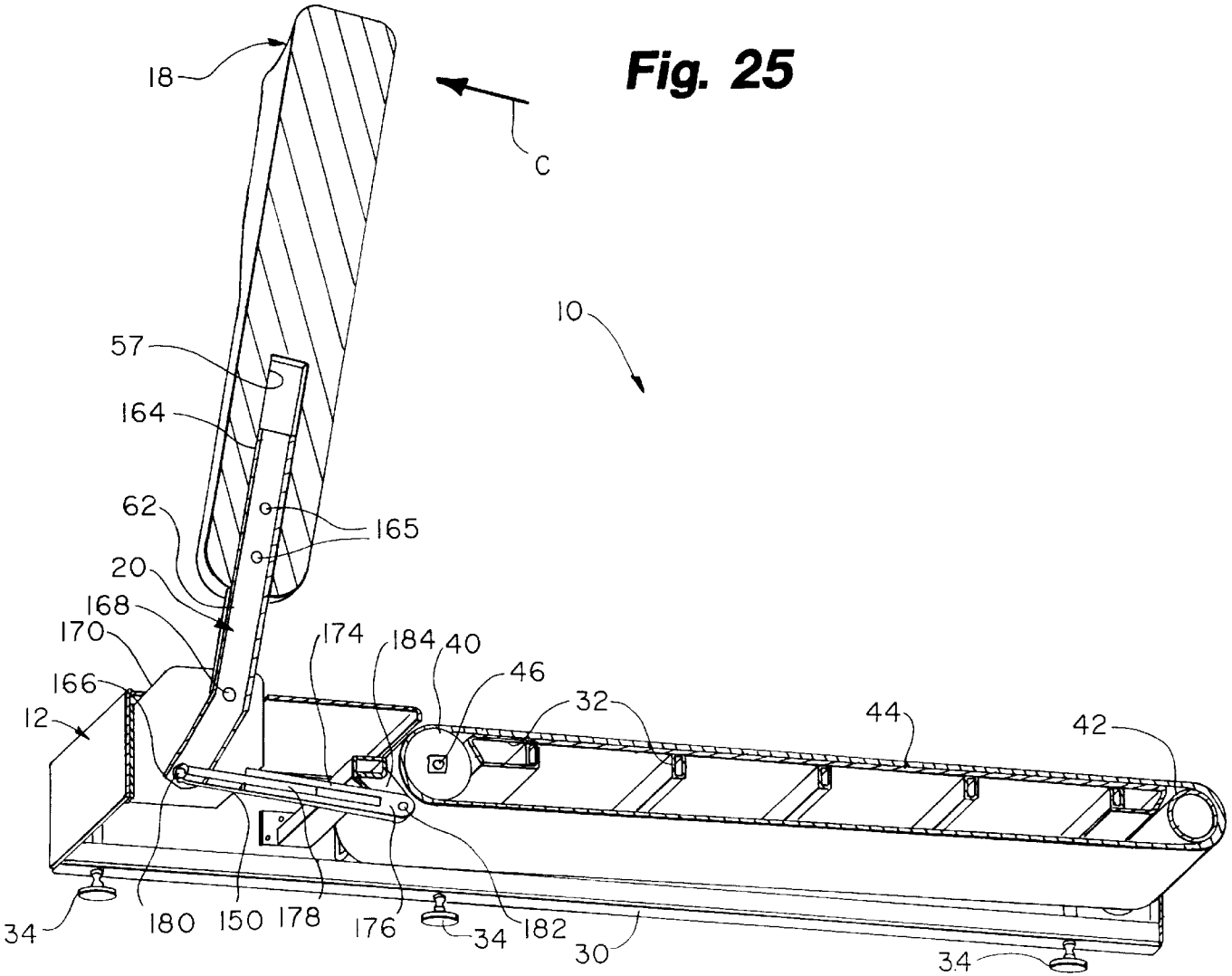
FIG. 25 is a perspective sectional view taken along the section line 25—25 of FIG. 24.
Figure 26:
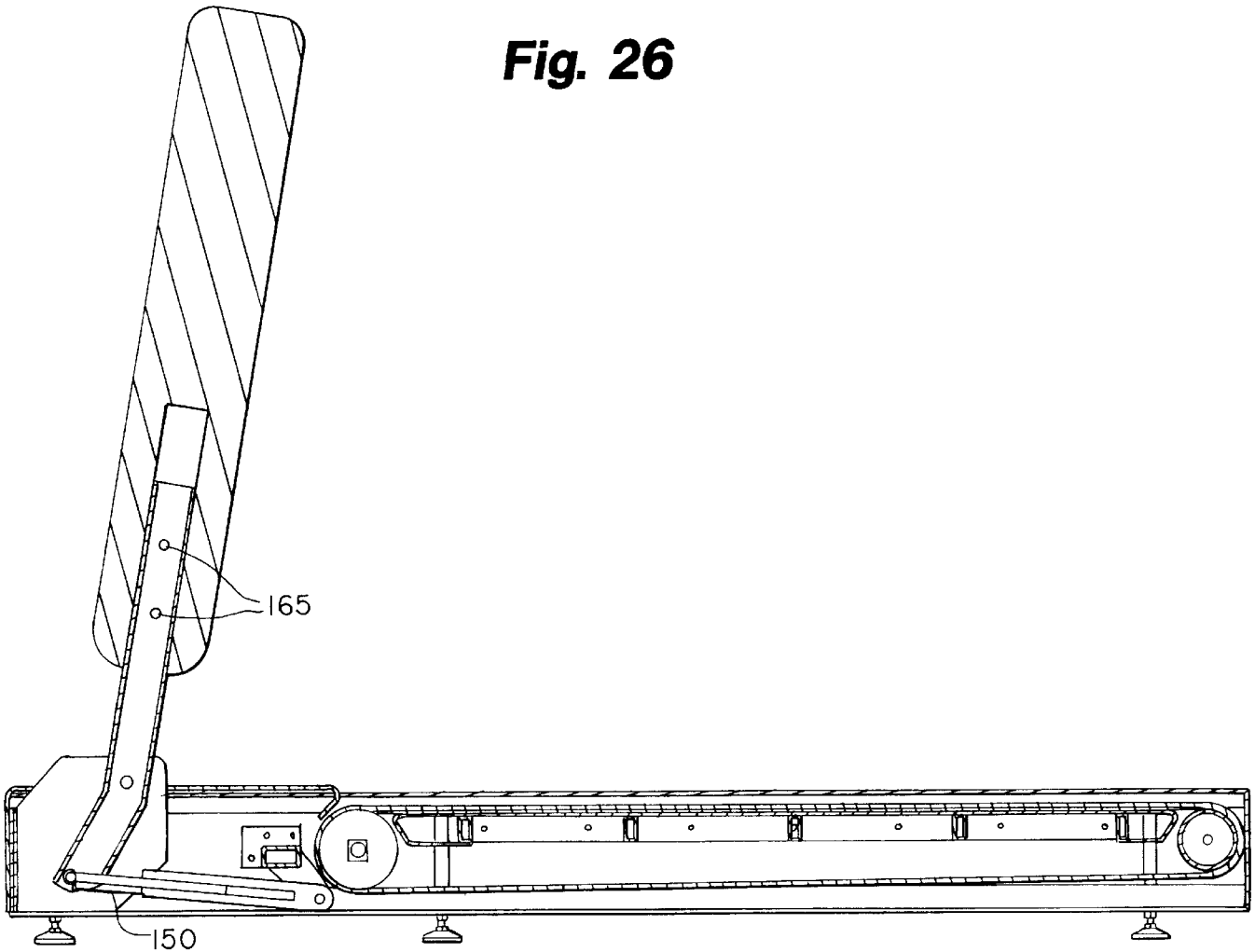
FIG. 26 is a sectional view taken along the section line 25—25 of FIG. 24.

Controlling elements of the treadmill control system 16 are positioned proximate the readout 96. The first such control is a pressure adjustment wheel 16. The pressure adjustment wheel 16 imposed a load on the variable caliber 50, which in turn applies pressure to the disk brake 48. See FIG. 24*a*. A pressure gauge 49 provides a pressure acting on the variable caliber 50. The pressure registered on the pressure gauge 49 that is dialed in by the tension adjuster 51 is sensed by the performance measurement system 22. The dummy support 20 of the present embodiment has been considerably changed with respect to the aforementioned dummy support 20. In the instant embodiment, beam 62 comprises a pivotable generally upright member. The beam 62 projects through an aperture defined in the platform 163. Referring to FIGS. 25 and 26, the beam 62 has a first end 164 that is removably received within a receiver 57 defined in the blocking dummy 18. The first end 164 is secured to the blocking dummy 18 by fasteners 165 that may be removable for replacement of the blocking dummy 18 or for the height of the blocking dummy 18 relative to the platform 163. The fasteners 165 may be pins or bolts or the like that are readily accessible for ease of removal as desired.

The beam 62 is pivotally coupled to the frame 12 at a pivot point 168. The beam 62 may be coupled by a pivot pin 172 disposed in bores that are in registry and defined in the beam 62 and in two flanking support brackets 170 disposed on either side of the beam 62. The support brackets 170 are fixedly coupled to the frame 12.

A second end 166 of the beam 62 depends from the pivot point 168. In a preferred embodiment, a slight bend in the beam 62 proximate the pivot point 168 projects the send end 166 toward the forward end of the treadmill sled 10.

A damper 74 operably couples the second end 166 of the beam 62 to the frame 12. In the sectioned representation of FIGS. 25 and 26, it can be seen that the damper 174 has a cylinder housing 176 and a translatable piston 178 disposed in part within the cylinder housing 176. The piston 178 is coupled by a pivotable coupling 180 to the second end 166 of the beam 62. Likewise, the cylinder housing 176 is coupled by a pivotable coupling 182 at a distal end thereof to a damper bracket 184. The damper bracket 184 preferably has two portions that flank the cylinder housing 176. The damper bracket 148 is fixedly coupled to the frame 12.

A force as indicated by arrow C in FIG. 25 that is imparted to the blocking dummy 18 results in the beam 62 rotating about the pivot point 168. Such action forces the piston 178 into the cylinder housing 176 against a resistance that is preferably hydraulic. The amount that the piston 178 is forced into the cylinder housing 176 is measured by an extension sensor 158. The extension sensor 158 is preferably a string potentiometer that is disposed generally parallel to the damper 174. The output of the extension sensor 150 is preferably connected to the performance measurement system 22.

Figure 27:
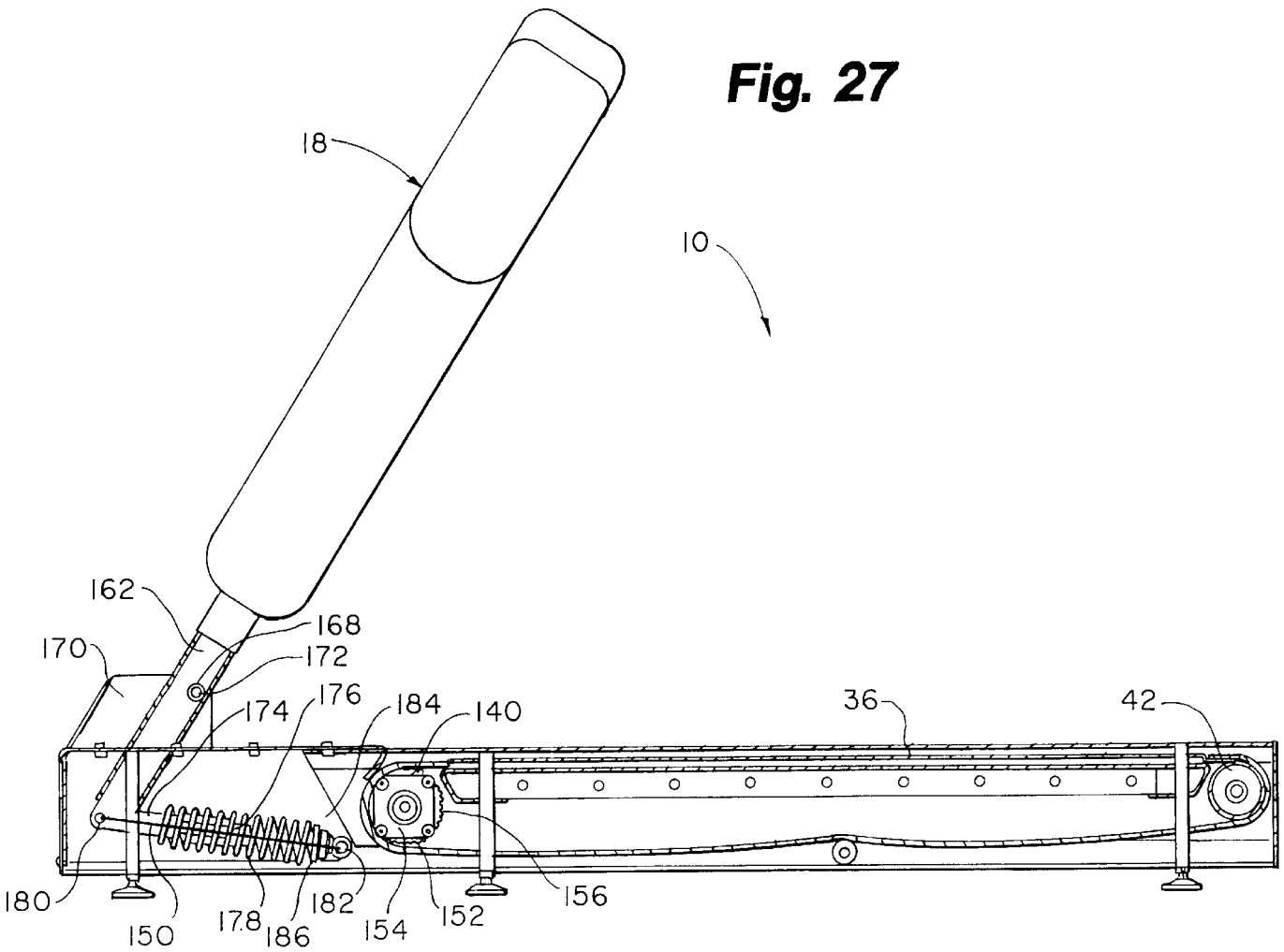
FIG. 27 is a sectional side view of a another embodiment of the present invention.
Figure 28:
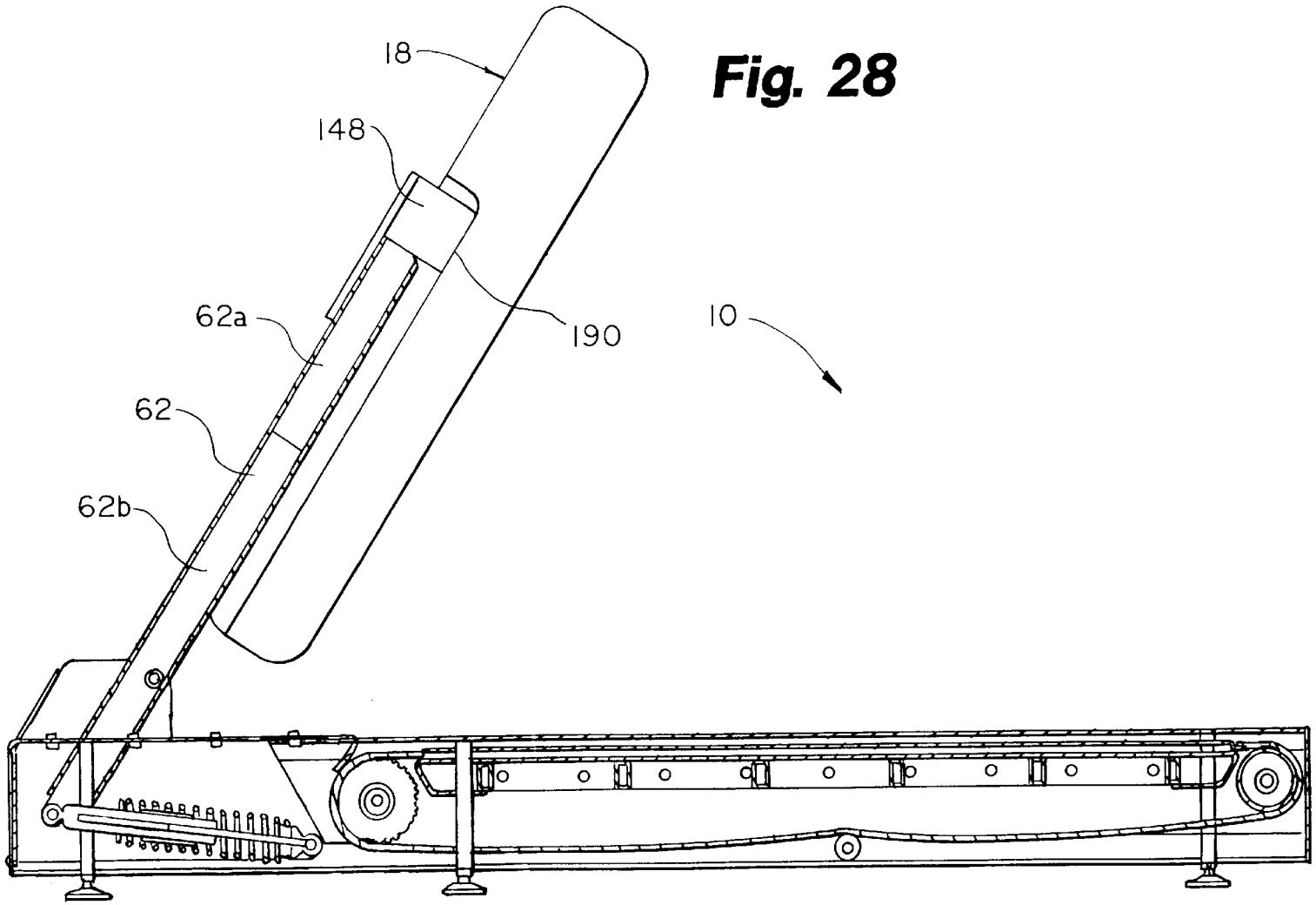
FIG. 28 is a sectional side view of the embodiment of FIG. 27 wherein the blocking dummy is mounted on a load cell.
Figure 29:
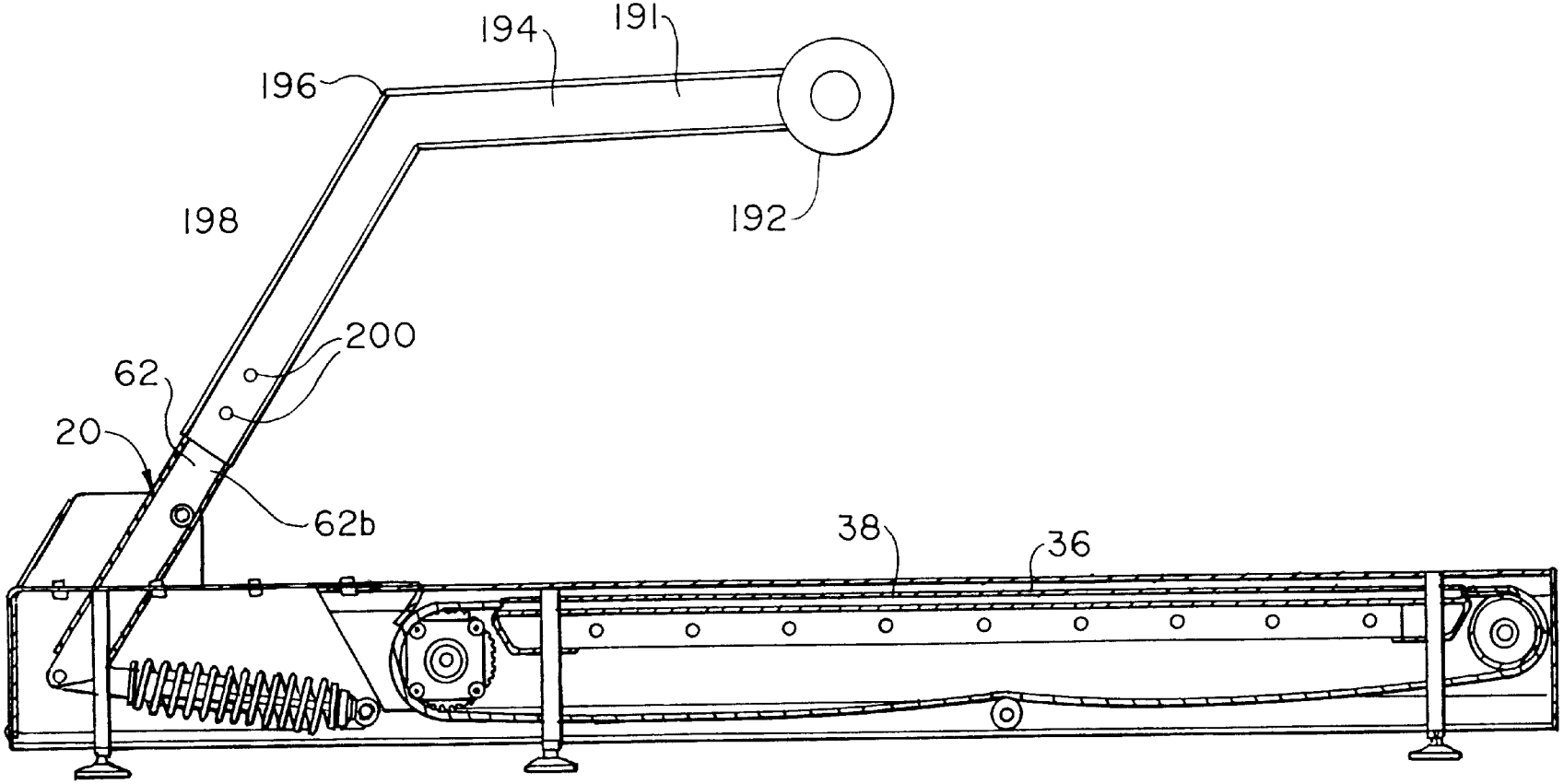
FIG. 29 is a sectional side view of the embodiment of FIG. 27 having a pad for resistive running.

A further embodiment of the treadmill sled 10 of the present invention is depicted in the sectional representations of FIGS. 27–29. These embodiments of the treadmill sled 10 may or may not include performance measuring system 22 as described with reference to the previous embodiments. As depicted in FIG. 27, the treadmill sled 10 includes a power system 152 having an electric motor 154 and a belt drive 156. Further, this embodiment traditionally includes a variable speed transmission coupling the electric motor 154 to the first roller 40.

In the embodiment of FIG. 27, the treadmill sled 10 is a generally straight beam 62. The configuration of FIG. 27 results in the blocking dummy 18 being tilted downward toward the continuous belt 36. An athlete impacting the blocking dummy 18 must exert both an upward and forward force on the blocking dummy 18. In the embodiment of FIG. 27, the blocking dummy 18 is coupled to the beam 62 substantially as described with reference to the embodiment of FIGS. 25 and 26.

In the embodiment of FIGS. 27–29, a coil over spring 186 is disposed about the damper 174. The coil over spring 186 acts in cooperation with the damper 174 to resist the force imparted to the blocking dummy 18 by an athlete disposed on the continuous belt 36.

Turning to FIG. 28, the blocking dummy 18 is coupled to the beam 62 by a single point attachment 190. The single point attachment 190 includes a force sensor 148 disposed therein. The force sensor 148 is in communication with the performance measurement system 22. It should be noted that the beam 62 is formed of two collinear portions, beams 62*a* and 62*b*. The beam 62*a* is detachable from beam 62*b*, leaving a stub of the beam 62. With reference to the embodiment of FIG. 29, a resistive running device 191 is coupled to the beam 62*b*. The resistive running device 191 includes a generally tubular pad 192. The tubular pad 192 is disposed generally at a height that approximates the lower torso portion of a runner. Accordingly, a runner disposed on the continuous belt 36 is positioned with the lower torso, upper pelvic region resting against the pad 192.

The tubular pad 192 is fixedly coupled to an arm 194 that extends forward from the pad 192. The arm 194 preferably has an elbow 196 and a generally depending connecting 198. The connecting arm 198 is connected to the beam portion 62*b* by readily removable pins 200. A plurality of bores may be defined in either or both the connecting arm 198 and the beam portion 62*b* in order to adjust the height of the pad 192 relative to the support surface 38 of the continuous belt 36.

In operation, the embodiment of FIG. 29 may be utilized with a certain amount of rotational resistance dialed in to the continuous belt 36 by the tension adjuster 51 acting on the variable caliber 50. A user may then lean into the tubular bed 192 and exert a certain amount of running force on the support 38 of the continuous belt 36.

It will be obvious to those skilled in the art that other embodiments in addition to the ones described herein are indicated to be within the scope and breadth of the present application. Accordingly, the applicant intends to be limited only by the claims appended hereto.

What is claimed is:

1. A treadmill sled for developing and measuring the prowess of an athlete user, comprising:

a frame;

a rotatable continuous belt mounted on the frame, the belt presenting an upward directed support surface for supporting a user athlete, a blocking dummy supported proximate the continuous belt and being operably coupled to the frame by a dummy support; and a performance measuring system, the performance system measuring at least a user athlete's reaction time, the distance traveled by the user athlete in a certain period of time, and the positioning of the user athlete's hands relative to the blocking dummy.

2. The treadmill sled of claim 1 further including a brake operably coupled to the continuous belt, the brake imparting a selectively variable resistance to a rotating motion of the continuous belt.

3. The treadmill sled of claim 1 wherein the performance measuring system includes a processor.

4. The treadmill sled of claim 3 wherein the processor calculates the force required to rotate the continuous belt, the force utilized in conjunction with the distance traveled by the user athlete determining a power output of the user athlete.

5. The treadmill sled of claim 3 wherein the performance measuring system includes a force sensor communicatively coupled to the processor, the force sensor measuring elongation of a biasing member, the elongation being responsive to a force exerted by the user athlete on the blocking dummy.

6. The treadmill sled of claim 5 wherein the performance measuring system includes a plurality of multi-axis sensors communicatively coupled to the processor, the multi-axis sensors being operably coupled to the blocking dummy.

7. The treadmill sled of claim 6 wherein the plurality of multi-axis sensors are kinetically coupled to the blocking dummy, said coupling facilitating sensed data being addable to obtain resultant forces and moments imparted by the user athlete to the blocking dummy.

8. The treadmill sled of claim 1 wherein the dummy support is fixed.

9. The treadmill sled of claim 1 wherein the dummy support includes a shiftable support frame.

10. The treadmill sled of claim 9 wherein the shiftable support frame is operably coupled to the blocking dummy by a three point attachment.

11. The treadmill sled of claim 9 wherein a shifting of the shiftable support frame in a certain direction is opposed by a biasing member.

12. The treadmill sled of claim 1 further including a motor mounted on the frame and operably rotatably coupled to the continuous belt for selectively imparting rotating motion to the continuous belt.

13. The treadmill sled of claim 12 wherein the motor is operably coupled to the continuous belt by a transmission, the transmission being substantially infinitely variable for imparting a variable velocity to the continuous belt.

14. The treadmill sled of claim 12 wherein the motor is operably coupled to the continuous belt in an isokinetic mode, the continuous belt being driven at a constant velocity.

15. The treadmill sled of claim 12 wherein the continuous belt is operated in an isotonic mode, a constant resistance being applied to the continuous belt, the continuous belt velocity being a function of the force applied by the user athlete.

16. The treadmill sled of claim 12 wherein the continuous belt is operated in a matching speed mode, the processor acting to increase or decrease the velocity of the continuous belt as a function of the force applied by the user athlete.

* * * * *